US008052489B2

(12) United States Patent
Mase et al.

(10) Patent No.: US 8,052,489 B2
(45) Date of Patent: Nov. 8, 2011

(54) CONNECTOR

(75) Inventors: Tsuyoshi Mase, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 10 days.

(21) Appl. No.: 12/624,495

(22) Filed: Nov. 24, 2009

(65) Prior Publication Data

US 2010/0136819 A1 Jun. 3, 2010

(30) Foreign Application Priority Data

Dec. 1, 2008 (JP) ..... 2008-306618
Dec. 1, 2008 (JP) ..... 2008-306636
Dec. 1, 2008 (JP) ..... 2008-306662

(51) Int. Cl.
*H01R 13/627* (2006.01)

(52) U.S. Cl. ..... 439/752; 439/595; 439/677

(58) Field of Classification Search ..... 439/752, 439/677, 595, 680
See application file for complete search history.

(56) References Cited

U.S. PATENT DOCUMENTS 5,816,841 A * 10/1998 Grant ..... 439/354
6,193,495 B1 2/2001 Sasai et al.
6,206,717 B1 3/2001 Matsumoto
6,296,523 B1 10/2001 Sasai
2003/0199206 A1* 10/2003 Mase et al. ..... 439/752
2004/0005821 A1* 1/2004 Nankou et al. ..... 439/752
2004/0102094 A1* 5/2004 Hall et al. ..... 439/608
2004/0253884 A1* 12/2004 Sakurai et al. ..... 439/752
2006/0189219 A1* 8/2006 Yamashita et al. ..... 439/752
2007/0281555 A1* 12/2007 Suemitsu et al. ..... 439/752
2009/0081908 A1* 3/2009 Martin et al. ..... 439/752

FOREIGN PATENT DOCUMENTS

JP 2008-065985 3/2008

* cited by examiner

*Primary Examiner* — Hien Vu
(74) *Attorney, Agent, or Firm* — Gerald E. Hespos; Michael J. Porco

(57) ABSTRACT

A connector is provided with a pair of female and male housings (10, 40) connectable with each other. The female housing (10) includes a block-shaped housing main body (11) and the male housing (40) includes a receptacle (42) having an inner surface shape conforming to outer surfaces of the housing main body (11). Corners on the outer surface of the housing main body diagonal to each other are bevels (14, 15) with different shapes. The bevels (14, 15) include moderately inclined portions (14) located at the opposite ends of the upper surface of the housing main body (11) and inclined at a relatively large angle with respect to a height direction and steeply inclined portions (15) located at the opposite ends of the lower surface of the housing main body (11) and inclined at a relatively small angle with respect to the height direction.

7 Claims, 20 Drawing Sheets

CONNECTOR

BACKGROUND OF THE INVENTION

1. Field of the Invention

The present invention relates to a connector.

2. Description of the Related Art

U.S. Pat. No. 6,206,717 discloses a connector with male and female housings that are connectable with each other. The female housing includes a block-shaped housing main body and the male housing includes a receptacle having an inner surface shaped conforming to outer surfaces of the female housing. A projection is provided on an outer surface of the female housing, and a receiving groove is formed in the male housing. The projection is fit into the receiving groove when the two housings are connected properly. However, the projection contacts the front end edge of the male housing to prevent further connection if the female housing is oriented erroneously, thereby preventing further connection.

The female housing is bulkier than a female housing with no projection by at least as much as a projecting distance of the projection. Thus, the projection could interfere with the opening edge of a through hole of a panel and could hinder insertion of the female housing into the through hole in the panel if the opening diameter of the through hole is specified to be small.

U.S. Pat. No. 6,296,523 discloses a connector that has a block-shaped housing with a plurality of cavities for receiving terminal fittings. A resiliently deformable locking lance is formed at an inner surface of each cavity for retaining the terminal fitting. An erroneous connection preventing rib is provided on an outer surface of the housing for preventing an erroneous connection with a mating housing. Specifically, the erroneous connection rib extends in forward and backward directions at a position displaced toward one lateral side from a widthwise center of the housing.

The strength of the housing is weakened by forming the cavities penetrating the housing. The erroneous connection preventing rib could be arranged on a thin wall of the housing that also supports the base ends of the locking lances. The thin wall that supports both the erroneous connection preventing rib and the locking lances could be deformed to bulge out when the locking lance is deformed by inserting or withdrawing the terminal fitting into or from the cavity, thereby changing the position of the erroneous connection preventing rib. Further, the thin wall could be deformed into the cavity if the erroneous connection preventing rib interferes with external matter, thereby changing the position of the erroneous connection preventing rib. The erroneous connection preventing portion may not function properly in a shifted position.

Japanese Unexamined Patent Publication No. 2008-65985 discloses a connector to be built in a vehicle mirror. This connector has a housing capable of accommodating terminal fittings connected with ends of wires. The housing is mounted into a holder, which in turn is to be is fixed to a door mirror.

The holder is in the form of a box with open front and rear ends and one open side surface, and the housing is inserted through the opening in the side surface of the holder. The housing mounted in the holder is connected with a mating housing through the opening of the front surface of the holder. Wires extend from the rear surface of the housing and are drawn out to the outside through the opening of the rear surface of the holder.

There have been certain mounting situations where it is desired to mount the housing into the holder with the rear surface of the housing in the lead and draw the wires out in a direction intersecting with forward and backward directions.

However, the above-described holder cannot be used in this manner. More particularly, the wires drawn out from the rear surface of the housing may be bent forcibly and it may be difficult to arrange the wires unless there is a sufficient space between the rear surface of the housing and the holder.

The invention was developed in view of the above, and an object thereof is to provide a connector that prevents erroneous connection of two housings.

SUMMARY OF THE INVENTION

The invention relates to a connector with first and second housings that are connectable with each other. The first housing includes a substantially block-shaped housing main body and the second housing includes a receptacle with an inner surface shape substantially conforming to outer surfaces of the housing main body. Corners of the outer surfaces of the housing main body diagonal to each other are beveled with different shapes.

The bevels conform to corresponding parts of the receptacle if the housings are in proper connecting postures and a connecting operation of the two housings proceeds without difficulty. On the other hand, the bevels do not conform to the corresponding parts of the receptacle if the housings are oriented improperly, and the connecting operation of the housings is hindered. Accordingly, an erroneous connection of the two housings is prevented. The bevels thus define means for preventing an erroneous connection without increasing the volume. Thus, the entire connector can be compact compared to connectors with a projection for this purpose.

The housing main body preferably has a retainer mount hole for receiving a retainer that retains terminal fittings accommodated in the housing main body is to be mounted. At least one retainer lock is provided on an inner surface of the retainer mount hole for holding the retainer in the housing main body.

The bevels preferably include at least one moderately inclined portion inclined at a relatively large angle with respect to an inserting direction of the retainer into the retainer mount hole and at least one steeply inclined portion inclined at a relative small angle with respect to the inserting direction.

The retainer lock preferably is at an inner side of and proximate to the moderately inclined portion. Thus, a region thicker than the steeply inclined portion is utilized to improve space efficiency. Accordingly, the connector is compact and prevents an erroneous connection of two housings The retainer preferably includes an exposure portion exposed to the outside through an opening of the retainer mount hole. At least the facing edge of the exposure portion is beveled so that wires are not likely to get caught. Thus, insulation coatings of the wires are not likely to be cut and wires are not likely to be caught by the facing edge of the exposure portion in a way that could inadvertently detach the retainer from the first housing.

The receptacle includes a locking recess with a lock for holding the first housing in a connected state. At least one restriction is provided in the locking recess. The first housing interferes with the restriction to prevent any further connection if the housing is in a vertically inverted and oblique posture to project into the inside of the locking recess. Therefore, the first housing cannot enter the receptacle while being held in the vertically inverted posture.

The invention also relates to a connector with a first housing that has cavities for receiving terminal fittings. At least one resiliently deformable locking lance is formed at an inner surface of each cavity for retaining the terminal fitting. An erroneous connection preventing portion projects from an outer surface of the first housing for preventing an erroneous connection with a mating second housing. The erroneous connection preventing portion is on a surface at the same side as the inner surfaces of the cavities connected with the base ends of the locking lances and substantially corresponds to a partition wall between adjacent cavities. Thus, unlike the above-described prior art with a thin wall between the erroneous connection preventing portion and the cavity, there is no likelihood of changing the position of the erroneous connection preventing portion even if the locking lance is deformed resiliently or external matter interferes with the erroneous connection preventing portion. As a result, the reliability of an erroneous connection preventing function is improved.

Outer surfaces of the first housing preferably include two shorter sides and two longer sides. An interlocking portion for holding the second housing in a connected state projects from one of the two shorter sides, whereas the erroneous connection preventing portion preferably projects from the other shorter side. Thus, the longer sides of the first housing can be used effectively and areas at the opposite widthwise ends of the smaller side can be used more effectively as compared with the case where the erroneous connection preventing portion is provided at each of the opposite widthwise ends of the interlocking portion. Thus, the erroneous connection preventing portion can enter a clearance formed between the first housing and a panel, for example.

The outer surface of the first housing preferably has cutouts at positions corresponding to the leading ends of the locking lances. Thus, the deformation spaces for the locking lances have no walls and the height of the first housing can be reduced. However, the leading ends of the locking lances are exposed through the cutouts and can be broken or fractured by external matter. Accordingly, the erroneous connection preventing portion preferably is disposed between adjacent cutouts and prevents external matter from interfering with the locking lances.

The invention also relates to a connector with a first housing that can accommodate terminal fittings connected with ends of wires. The wires are to be drawn out from an end of the first housing. The connector also includes a holder for receiving the first housing. A projecting plate portion projects back from the surface of the first housing and is arranged for at least partly surrounding the wires (W). The projecting plate portion is inserted and held into the holder on a mounting object with the rear end of the projecting plate portion in the lead. The holder is formed with a wire draw-out opening extending in a direction intersecting the forward and backward directions and is adapted to permit the wires to be drawn out to the outside. Thus, the housing can be mounted into the holder with the rear surface thereof in the lead. Further, a sufficient space for arranging the wires can be ensured in the projecting plate portion and the holder.

The projecting plate portion preferably has a housing-side wire draw-out opening extending in a direction intersecting the forward and backward directions and adapted to permit the wires to be drawn out to the outside. The wires are less likely to be bent forcibly in the projecting plate portion and the holder as compared with the case where they are drawn out only through the wire draw-out opening. Therefore a degree of freedom in arranging the wires is improved.

The projecting plate portion preferably includes a first plate and a second plate connected with the first plate in an intersecting direction with the first plate and having a free end.

The free end of the second plate may undergo a resilient deformation relative to the end that is connected with the first plate. Accordingly, the holder includes an inclination preventing portion for preventing inward inclination of the second plate toward the wires. Thus, the second plate will not deform when the projecting plate portion is mounted into the holder.

The holder preferably includes a holder interlocking portion and the projecting plate portion preferably includes a holder locking portion. The holder interlocking portion and the holder locking portion engaged each other to prevent the holder and the housing from being separated. The holder preferably is formed with a second-plate accommodating recess for receiving the second plate. The projecting plate portion preferably is positioned by inserting the second plate into the second-plate accommodating recess and, in this state, the holder interlocking portion and the holder locking portion are engaged.

The projecting plate portion may have a small thickness to meet a demand for miniaturization or the like and hence may be less rigid. Thus, there is a possibility that the projecting plate portion will deform and the holder interlocking portion and the holder locking portion may displace from proper locking positions to reduce locking reliability in the process of mounting the projecting plate portion into the holder. However, the projecting plate portion is positioned by inserting the second plate into the second-plate accommodating recess and the holder interlocking portion and the holder locking portion are engaged in this state. Therefore, the holder interlocking portion and the holder locking portion are brought reliably to the proper locking positions to improve the locking reliability.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
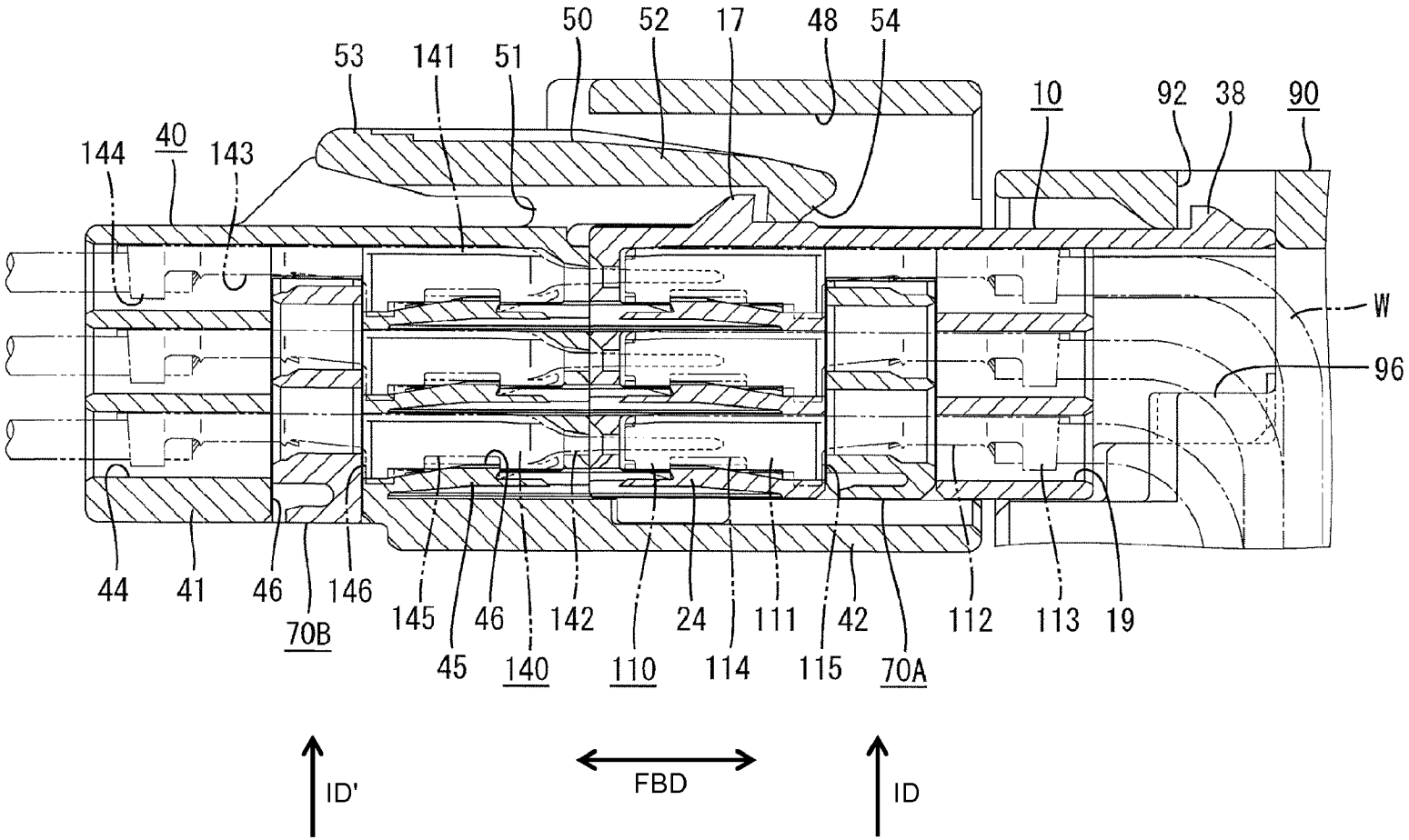
FIG. 1 is a section showing a state where a female housing is mounted in a holder and both female and male housings are properly connected in one embodiment of the invention.

A connector in according to the invention is described with reference to FIGS. 1 to 20. The connector has a female housing 10 that is connectable with a male housing 40 while being mounted in a holder 90. The holder 90 is provided integrally or unitarily on a mounting object of a vehicle body, such as a door mirror. In the following description, ends of the two housings 10, 40 that are to be connected are referred to as front ends, concerning forward and backward directions FBD, and reference is made to FIG. 1 concerning vertical direction.

The female housing 10 is made e.g. of synthetic resin and includes a substantially block-shaped housing main body 11. The housing main body 11 has a substantially rectangular cross section with two long parallel sides 12 arranged substantially vertically in FIG. 10 and short parallel upper and lower surfaces 13 arranged substantially in a lateral direction in FIG. 10.

Corners of the outer surfaces of the housing main body 11 define bevels 14, 15. The bevels 14 at the opposite ends of the upper surface of the housing main body 11 are shaped identically and the bevels 15 at the opposite ends of the lower surface of the housing main body 11 are shaped identically. Additionally, the bevels 14 at the opposite ends of the upper surface and the bevels 15 at the opposite ends of the lower surface diagonal to each other preferably are shaped differently. The respective bevels 14, 15 are formed over the substantially entire length of the housing main body 11 in forward and backward directions FBD.

The bevels 14 at the opposite ends of the upper surface have a relatively large angle of inclination with respect to the height direction and a relatively small angle of inclination with respect to the width direction. The bevels 15 at the opposite ends of the lower surface have a relatively small angle of inclination with respect to the height direction and a relatively large angle of inclination with respect to the width direction. Recesses 16 are formed between the moderately inclined portions 14 and the steeply inclined portions 15 in the opposite side surfaces of the housing main body 11 to constrict the housing main body 11. The upper and lower surfaces of the recesses 16 are slants and an angle of inclination of these slants is substantial equal to the angle of inclination of the bevels 14.

A table-shaped interlocking projection 17 is provided in a substantially central widthwise part of the upper surface of the housing main body 11 for holding the male housing 40 in a connected state. The front surface of the interlocking projection 17 has a guiding slant inclined up and out toward the back, and the rear surface thereof is a substantially vertical locking surface. A substantially flat platform 18 is provided immediately behind the interlocking projection 17 on the upper surface of the housing main body 11, and the upper surface of the platform 18 is substantially flat and slightly higher than surrounding upper surface areas. Further, the upper surface of the housing main body 11 is a substantially continuous flat surface at substantially the same height except for parts where the interlocking projection 17 and the platform 18 are formed.

Figure 17:
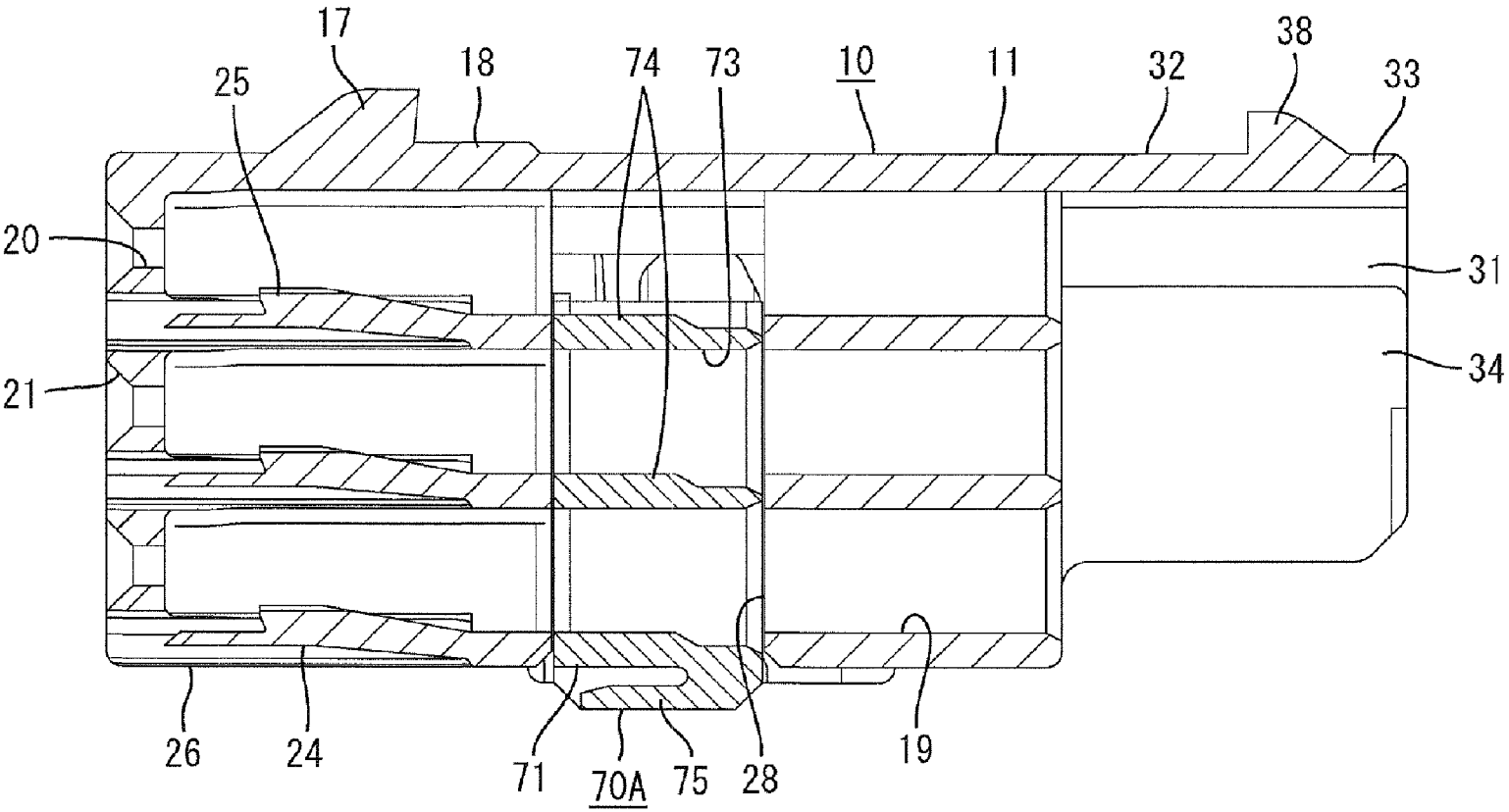
FIG. 17 is a section of a cavity part of the female housing showing the state where the female housing is held at the partial locking position.

Cavities 19 extend through the housing main body 11 in substantially in forward and backward directions FBD, as shown in FIG. 17, and are capable of accommodating female terminal fittings 110. A plurality of cavities 19 are partitioned side by side in the width direction in a plurality of height levels. Terminal insertion openings 20 are defined at the fronts of the cavities 19 and forwardly widening conical guides 21 surround the terminal insertion openings 20. The rear surface of the housing main body 11 serves as a wire draw-out surface, from which wires W connected with the female terminal fittings 110 are drawn out.

Figure 10:
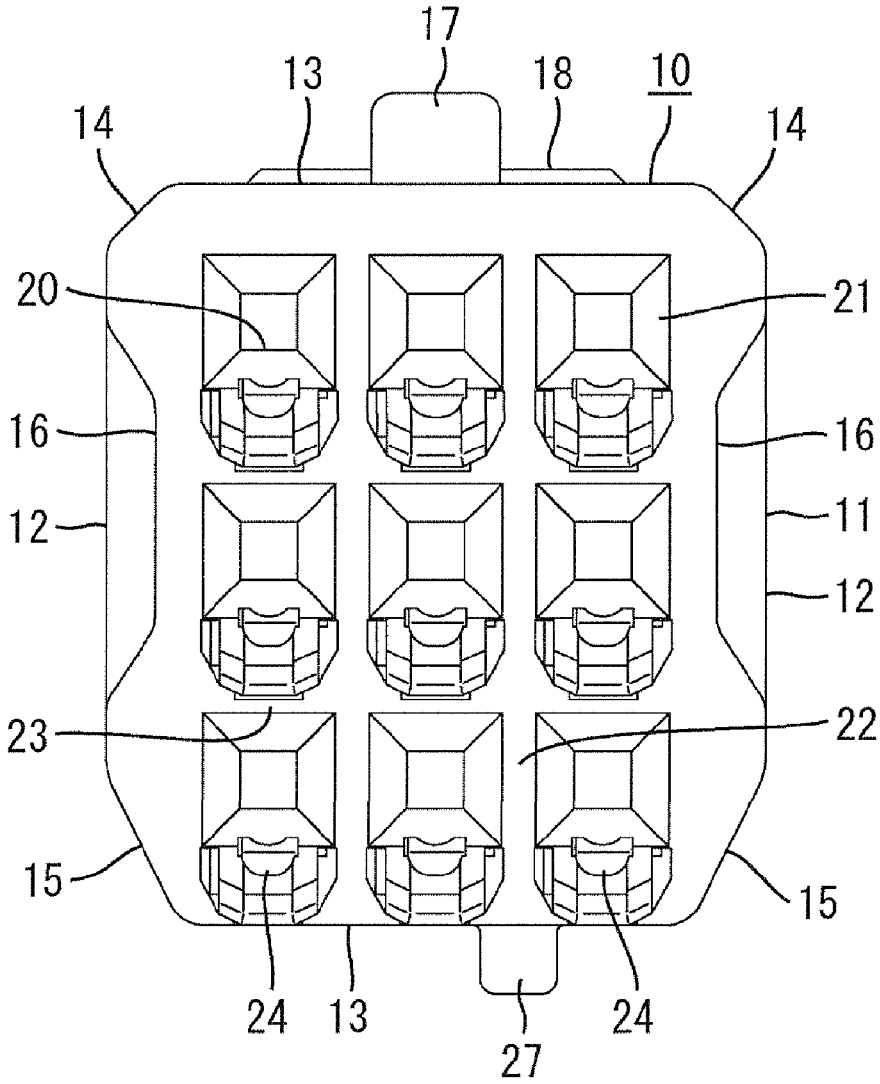
FIG. 10 is a front view of the female housing.

As shown in FIG. 10, vertical partition walls 22 partition the horizontally adjacent cavities 19 that are adjacent in the width direction and horizontal walls 23 partition the vertically adjacent cavities 19. A resiliently deformable locking lance 24 is provided at the inner lower surface of each cavity 19. The locking lance 24 is supported at both front and rear ends, and the front support is forked. A locking projection 25 is provided on the upper surface of the locking lance 24, and the female terminal fitting 110 is retained primarily in the cavity 19 by the resilient engagement of the locking projection 25 with the female terminal fitting 110.

Figure 14:
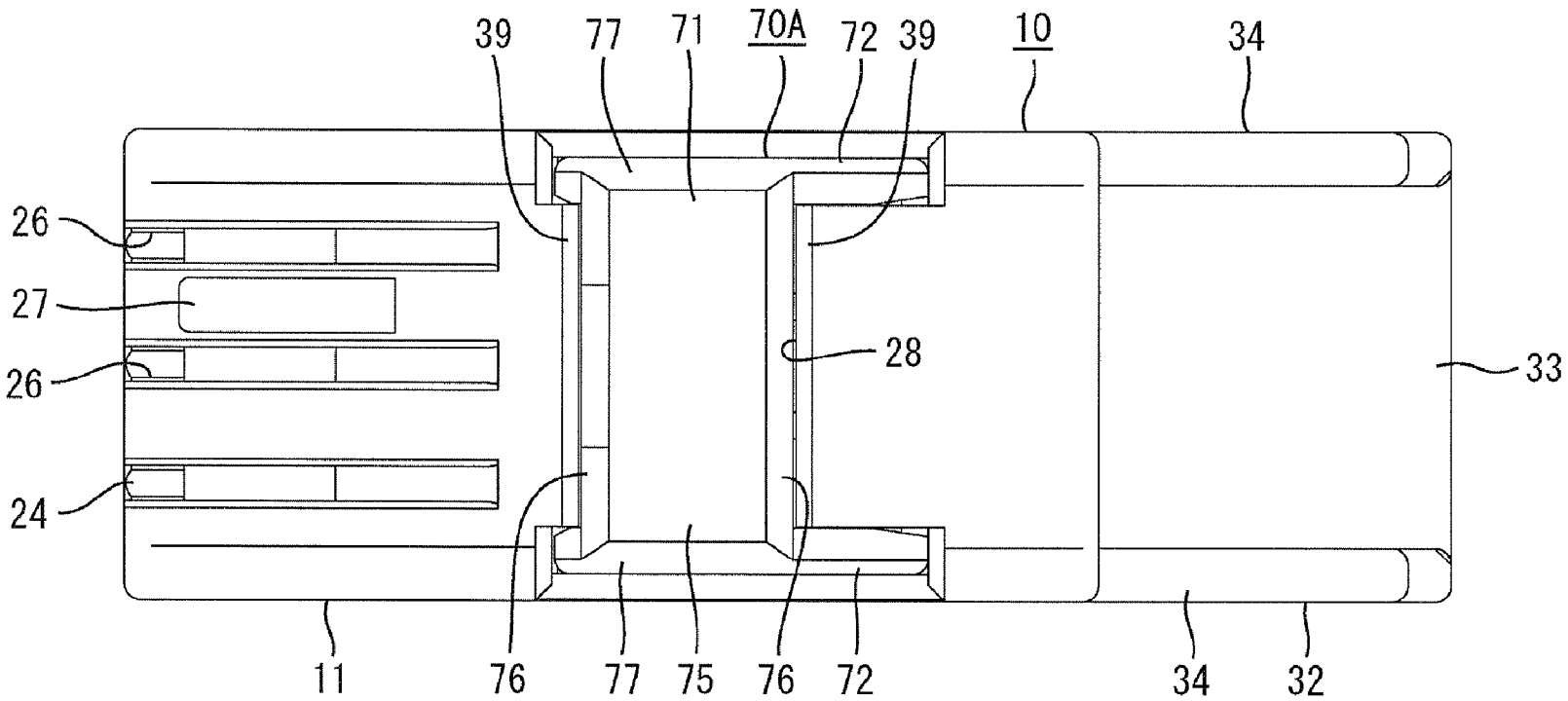
FIG. 14 is a bottom view of the female housing having the retainer mounted therein.

As shown in FIG. 14, leading ends of the locking lances 24 in the lowermost level are exposed to the outside through cutouts 26 formed in the lower surface of the female housing 10. The leading ends of the deformed locking lances 24 enter the cutouts 26, and the absence of a wall for forming deformation spaces for the locking lances 24 reduces the height of the female housing 10.

As shown in FIG. 10, an erroneous connection preventing rib 27 projects down and out at a position on the lower surface of the housing main body 11 displaced toward one lateral side from the widthwise center and prevents the female housing 10 from being connected erroneously with the male housing 40. The erroneous connection preventing rib 27 projects continuously in the height direction from one of the partition walls 22. The front end of the erroneous connection preventing rib 27 is slightly behind the front end of the female housing 10 and the rear end of the erroneous connection preventing rib 27 is located before the front end of the retainer mount hole 28. Further, the cutouts 26 are parallel with the erroneous connection preventing rib 27 at opposite widthwise sides of the erroneous connection preventing rib 27.

Figure 11:
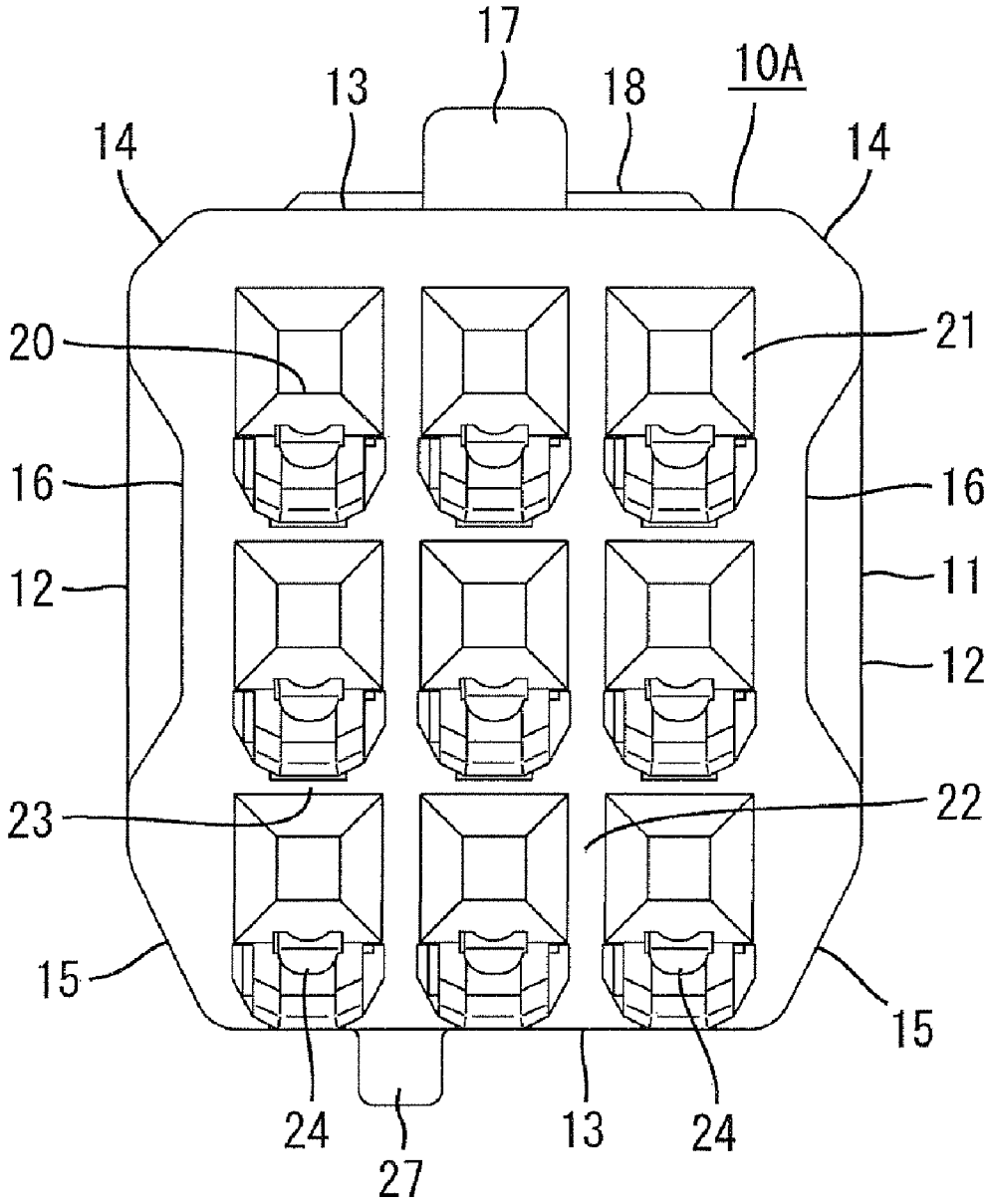
FIG. 11 is a front view of another female housing differing only in the arrangement position of an erroneous connection preventing portion.

Another female housing 10A is shown in FIG. 11 and has an erroneous connection preventing rib 27A at a different position. Specifically, the erroneous connection preventing rib 27A projects at a position of the surface (e.g. the lower surface) of this different female housing 10A displaced toward the other lateral side from the widthwise center and corresponding to the other one of the two partition walls 22. Accordingly, the structures of the both female housings 10, 10A are distinguished by the erroneous connection preventing ribs 27, 27A.

Figure 12:
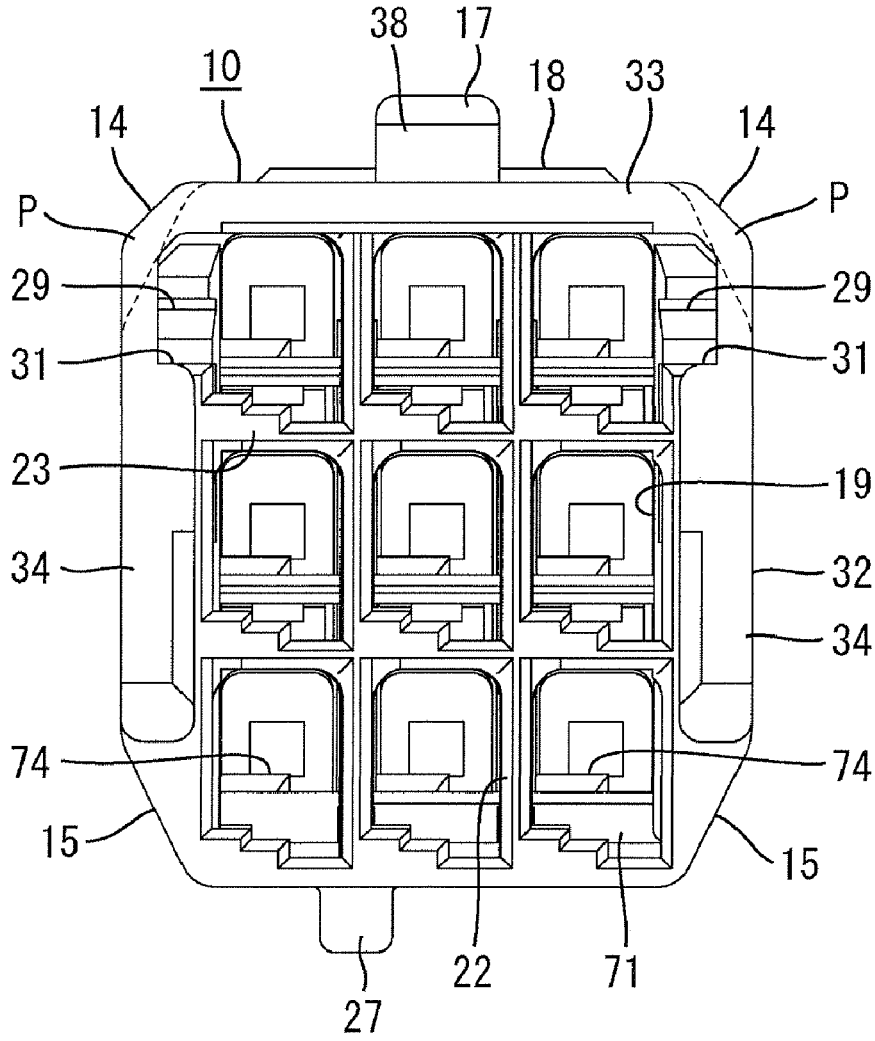
FIG. 12 is a rear view of the female housing.
Figure 15:
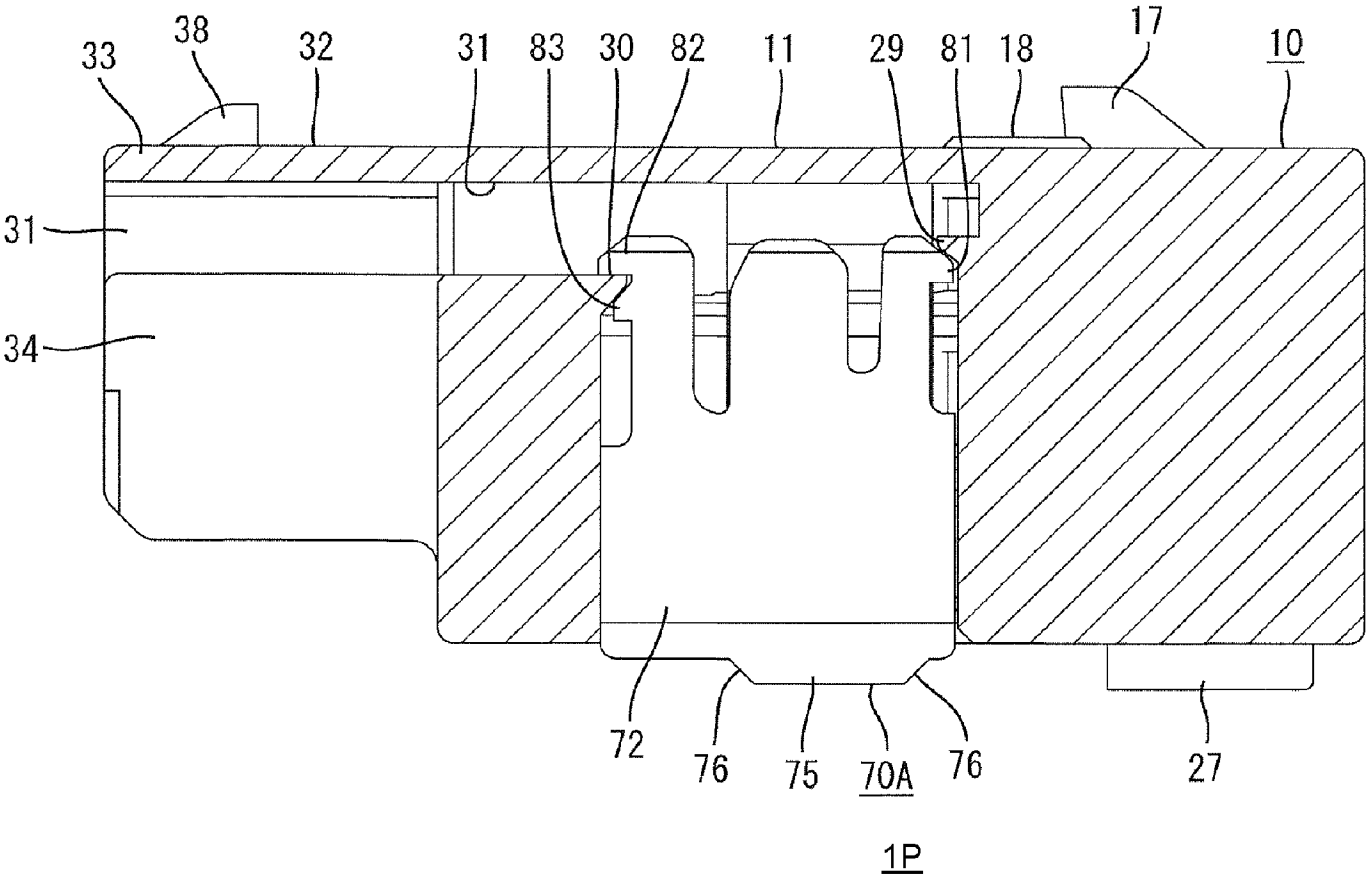
FIG. 15 is a section of a retainer locking portion of the female housing showing a state where the retainer is held at a partial locking position.

As shown in FIG. 17, the retainer mount hole 28 is formed in the lower surface and the bottom ends of the opposite side surfaces of the housing main body 11 and has a depth to communicate with all of the cavities 19. The retainer 70A is insertable into the retainer mount hole 28 from below. As shown in FIG. 15, first locks 29 project at opposite widthwise ends of the inner front surface of the retainer mount hole 28 at the upper end and second locks 30 project from the inner rear surface of the retainer mount hole 28 facing the inner front surface at positions lower than the first locks 29. A mold removal hole 31 is formed in the rear surface of the housing main body 11 by removing a mold to form the first locks 29. As shown in FIG. 12, the first locks 29 can be seen through the mold removal hole 31 from behind. Upper surfaces of the second locks 30 are continuous and flush with the inner lower surface of the mold removal hole 31.

The first locks 29 are provided at the inner sides of and proximate to the moderately inclined portions 14. Specifically, the first locks 29 are arranged at positions closer to the moderately inclined portions 14 than the center of the housing main body 11 with respect to the height direction and overlap with the moderately inclined portions 14 with respect to the width direction. Regions P that are thicker than the steeply inclined portions 15 are defined at the outer sides of the first locks 29 and at the inner sides of the moderately inclined portions 14 to avoid reducing the rigidity of the housing main body 11 due to the formation of the first locks 29.

Figure 9:
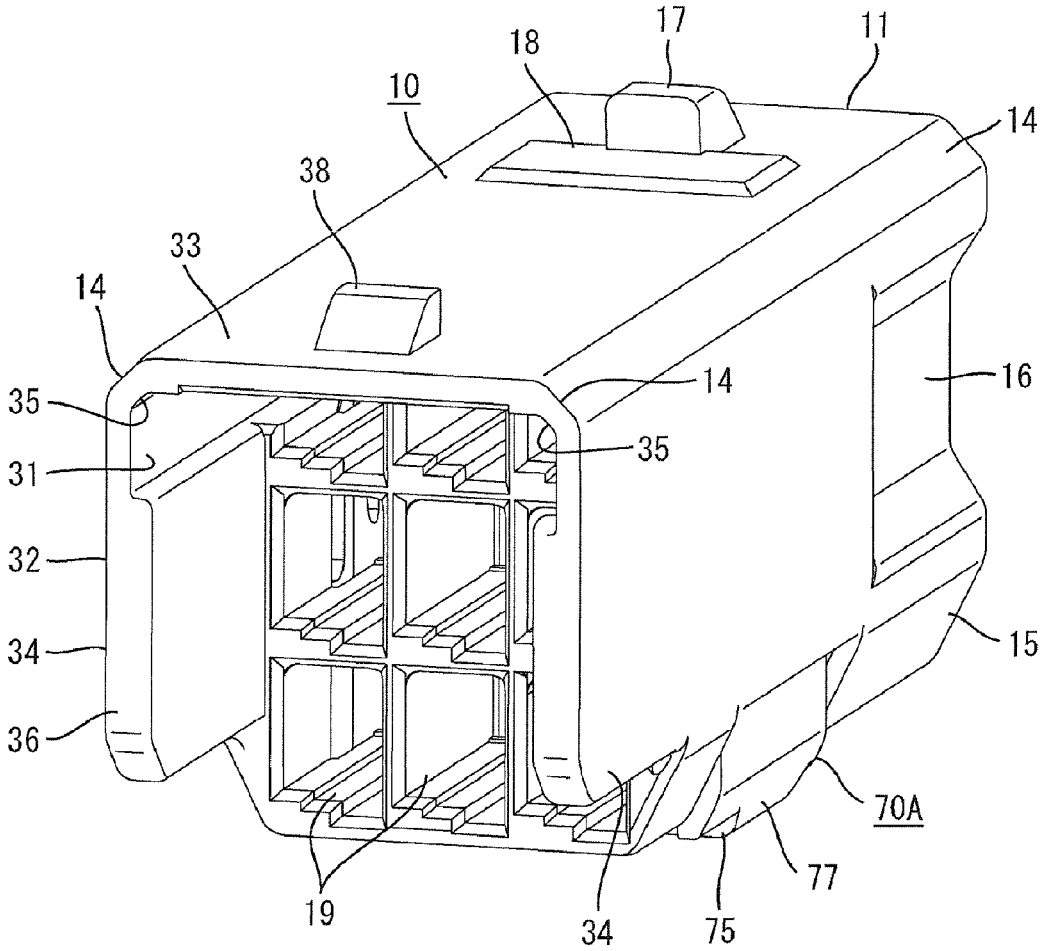
FIG. 9 is a perspective view of the female housing.

The female housing 10 includes at least one projecting plate portion 32 that projects unitarily back from the rear end of the housing main body 11. Specifically, the projecting plate portion 32 projects from the outer peripheral edge of the wire draw-out surface to at least partly surround the wires W drawn out from the wire draw-out surface and to avoid interference with the wires W. Additionally, the projecting plate portion 32 is to be inserted into the holder 90 with the rear end thereof in the lead. As shown in FIG. 9, the projecting plate portion 32 includes a first plate 33 with an upper surface continuous and flush with the upper surface of the housing main body 11 and left and right second plates 34 with outer surfaces continuous and flush with the opposite side surfaces of the housing main body 11. The second plates 34 are connected with the opposite widthwise sides of the first plate 33 in an intersecting direction and hang down. Thus, the projecting plate portion 32 is a substantially U-shaped frame with open rear and lower sides. The thickness of the projecting plate portion 32 is reduced sufficiently to meet a demand for miniaturization, and hence the second plates 34 are resiliently deformable in and out.

The moderately inclined portions 14 of the housing main body 11 are substantially continuous and flush with parts of the outer surface of the projecting plate portion 32 where the first plate 33 and the second plates 34 intersect. Inner inclined portions 35 arranged substantially in parallel with the moderately inclined portions 14 and/or spaced apart from the moderately inclined portions 14 by the thickness thereof are provided in parts of the inner surface of the projecting plate portion 32 where the first plate 33 and the second plates 34 intersect. The mold removal hole 31 preferably continuously extends from the housing main body 11 over the upper ends of the inner surfaces of the second plates 34, and the inner inclined portions 35 are formed by this mold removal hole 31.

Figure 5:
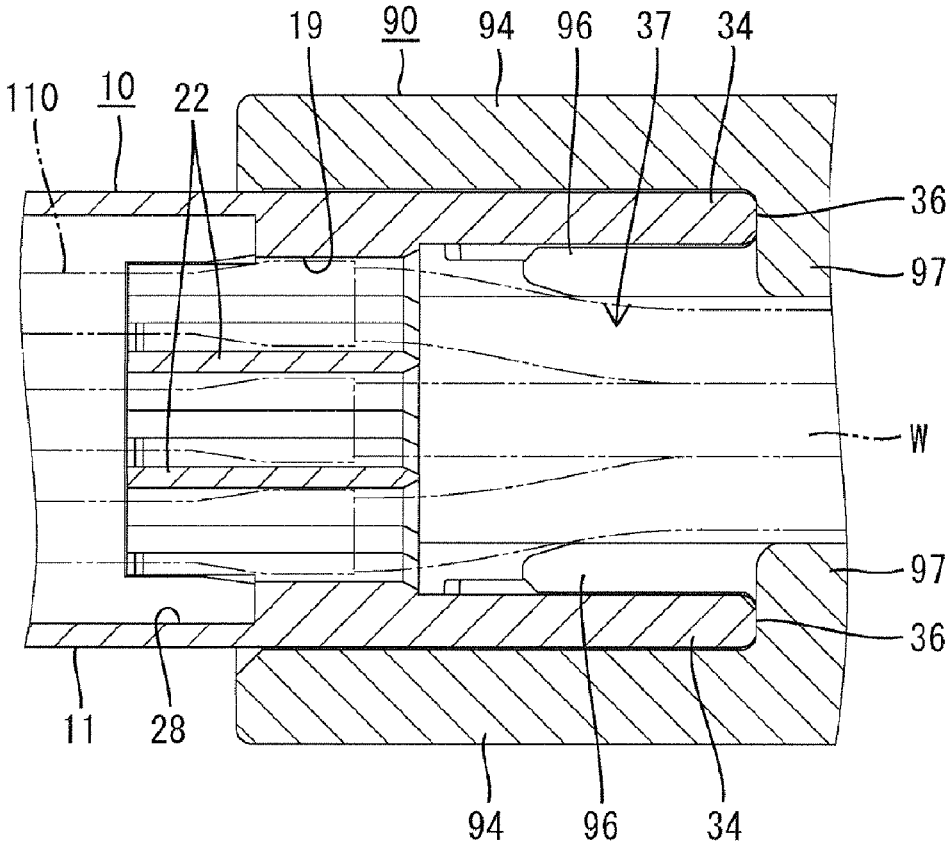
FIG. 5 is a section showing a state where the second plates are accommodated in the second-plate accommodating recesses in the connected state when viewed from above.
Figure 6:
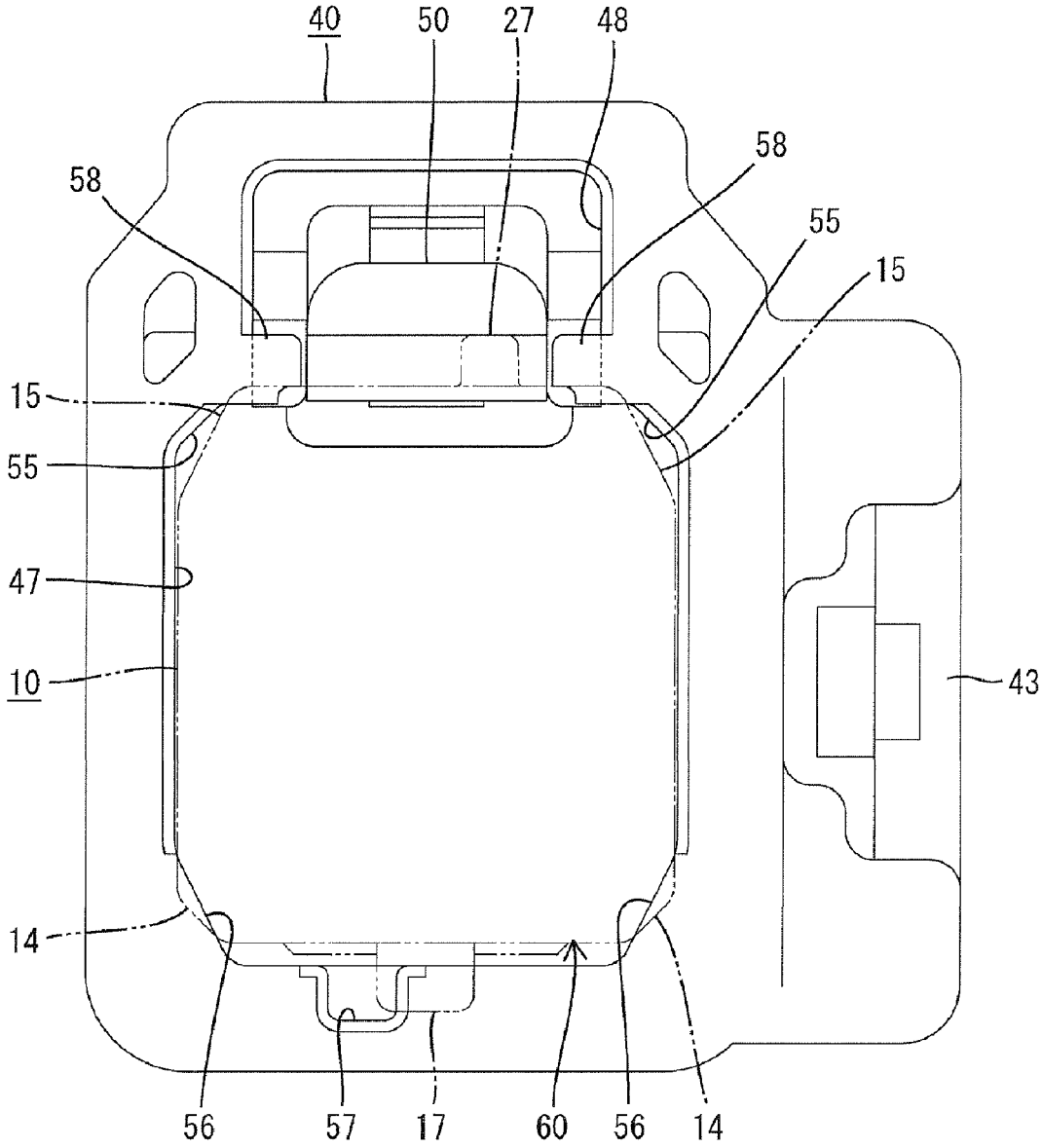
FIG. 6 is a front view showing a state where the female housing is in a vertically inverted posture and a connecting operation thereof is hindered.
Figure 7:
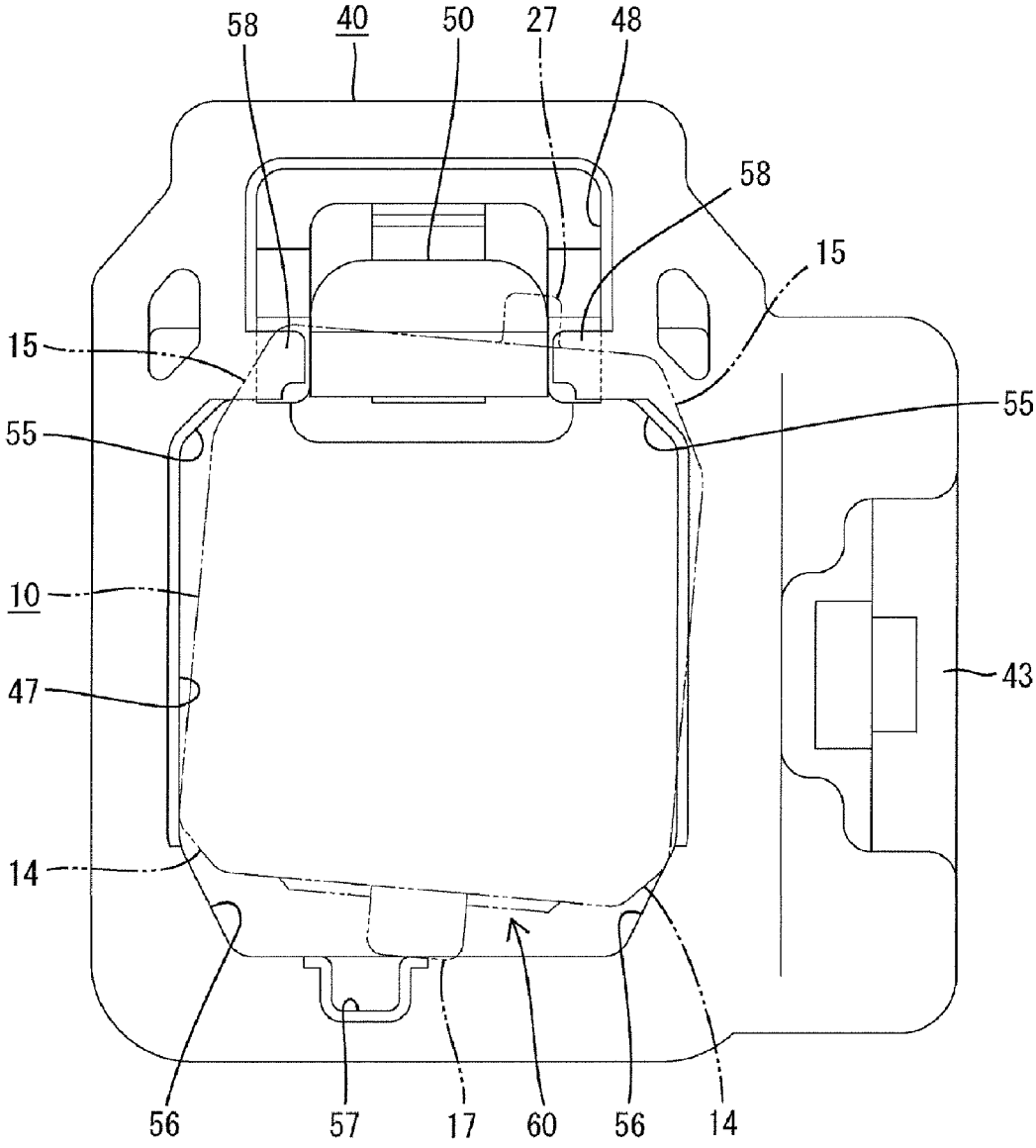
FIG. 7 is a front view showing a state where the female housing is in a vertically inverted and oblique posture and a connecting operation thereof is hindered.

The rear ends of the first and second plates 33, 34 are aligned at substantially the same position in forward and backward directions FBD, and form U-shaped contact end surfaces 36 when viewed from behind and come to rest in contact with the holder 90. The bottom ends of the two second plates 34 are aligned substantially at the same position as the upper end of the retainer mount hole 28 in the opposite side surfaces of the housing main body 11, and a housing-side wire draw-out opening 37 is formed between these two bottom ends as shown in FIG. 5. The wires W drawn out from the wire draw-out surface of the housing main body 11 are bent forcibly and deformed at the inner sides of the holder 90 and the projecting plate portion 32 and are drawn out down through a wire draw-out opening 99 of the holder 90 and the housing-side wire draw-out opening 37. A holder lock 38 projects in a widthwise central part of the upper surface of the first plate 33 for holding the female housing 10 so as not to be separated from the holder 90. The rear surface of the holder lock 38 forms a guiding slant that is inclined up toward the front, and the front surface of the holder lock 38 forms a substantially vertical locking surface. The interlocking projection 17 and the holder lock 38 are arranged on substantially the same axis extending in forward and backward directions FBD and have substantially the same width, but the interlocking portion 17 is slightly larger than the holder locking portion 38.

As shown in FIG. 1, each female terminal fitting 110 is bent, folded and/or embossed from a unitary electrically conductive metal plate to define a substantially tubular connecting portion 111 for receiving a mating tab 142, a wire barrel 112 behind the connecting portion 111 and an insulation barrel 113 behind the wire barrel 111. The wire barrel 111 is configured for connection a conductive core at the end of the wire W and the insulation barrel 11 is configured for connection with an insulation coating at the end of the wire W. A lance hole 114 is formed in the connecting portion 111 for receiving the locking projection 25, and a rear jaw 115 of the connecting portion 111 is engageable with the retainer 70A.

The retainer 70A is made of synthetic resin and has a lattice-shaped retainer main body 71 that extends in the width direction. Plate-like side pieces 72 are joined integrally at the opposite widthwise sides of the retainer main body 71 and project up as shown in FIGS. 14, 15 and 17. The retainer main body 71 has windows 73 capable of communicating with the respective cavities 19 in the middle and lower levels. A retaining projection 74 projects from the inner lower surface of each window 73 and is engageable with the rear jaw 115 of the female terminal fitting 110. Retaining projections 74 also are provided at positions on the upper end of the retainer main body 71 corresponding to the cavities 19 in the upper level.

Figure 13:
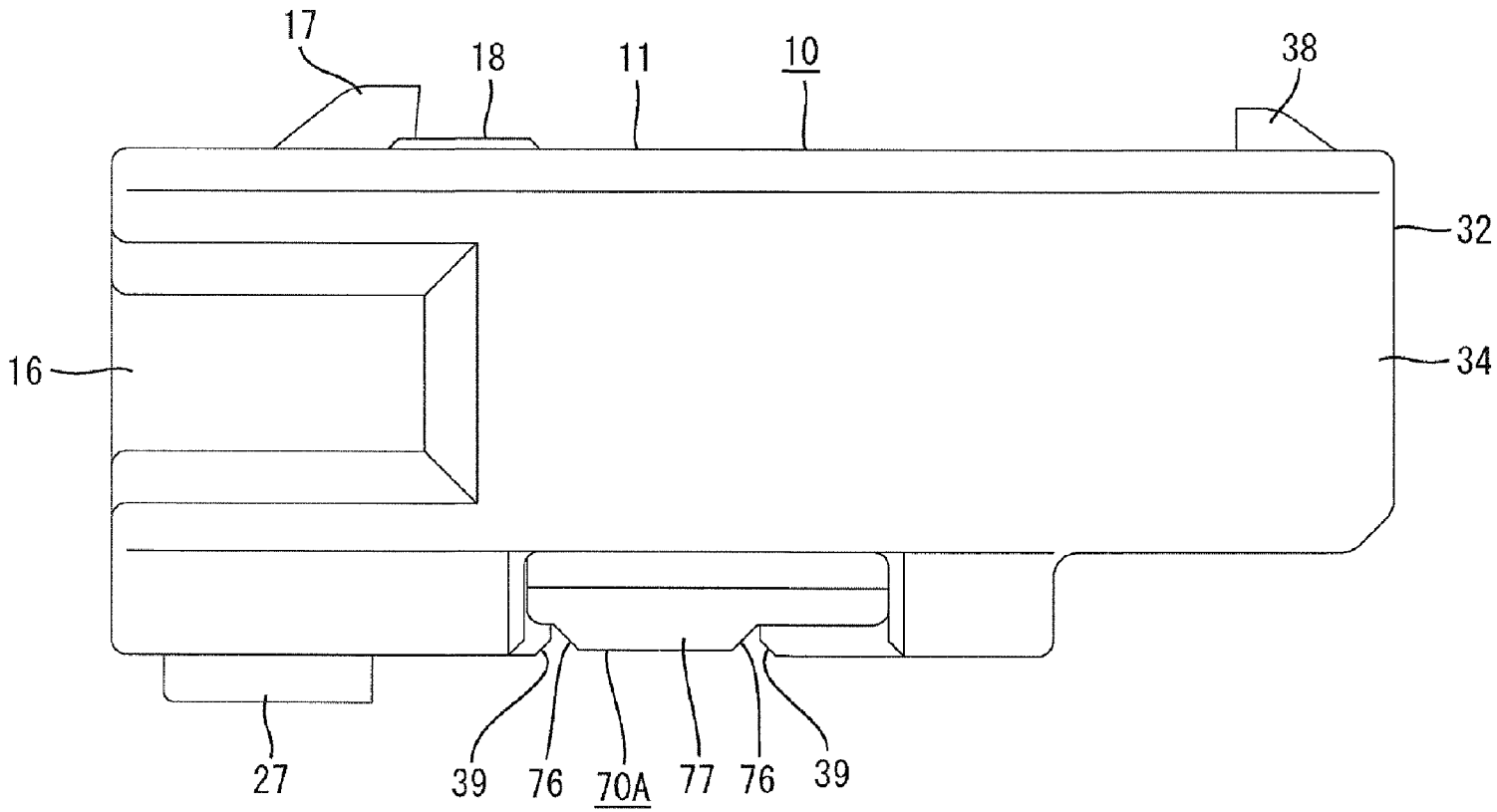
FIG. 13 is a side view of the female housing having a retainer mounted therein.

As shown in FIG. 14, an exposure portion 75 is provided at a bottom of the retainer 70A and is exposed to the outside through the retainer mount hole 28. Opposite front and rear end edges of the exposure portion 75 face front and rear edges of the opening of the retainer mount hole 28 and are beveled to form slants 76 that incline down over the entire width, as shown in FIG. 13. Similar slants 39 incline down on the opposite front and rear end edges of the opening of the retainer mount hole 28 over substantially the entire width. Thus, recessed spaces are formed between the slanted portions 39 and 76.

Figure 16:
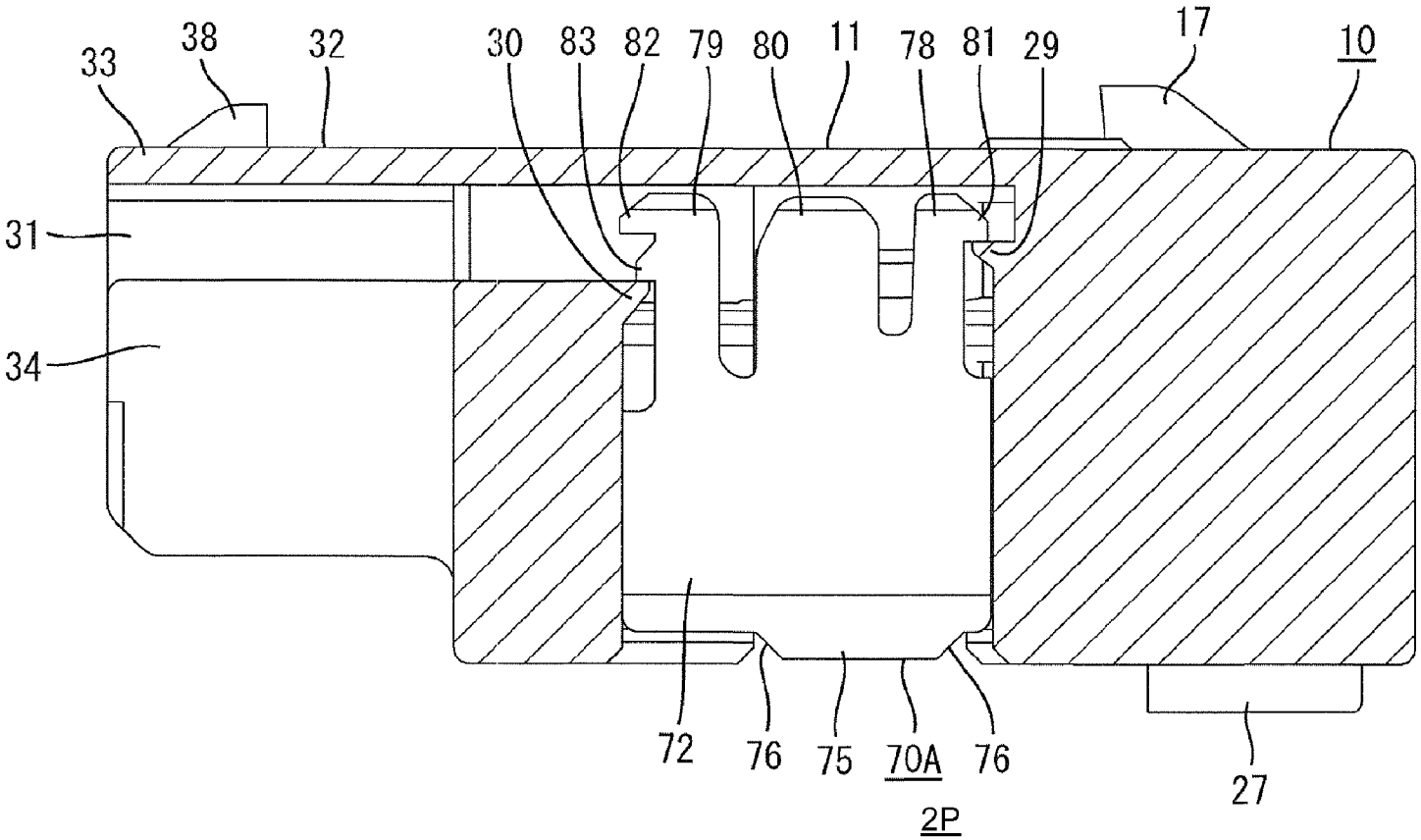
FIG. 16 is a section of the retainer locking portion of the female housing showing a state where the retainer is held at a full locking position.

Slants 77 corresponding to the steeply inclined portions 15 are formed at the bottom ends of the outer surfaces of both side pieces 72. Thus, the side pieces 72 do not project sideways from the opposite side surfaces of the housing main body 11 at a full locking position to be described later. As shown in FIG. 16, a resiliently deformable first interlocking portion 78 projects up near the front side of each of the side pieces 72 and a resiliently deformable second interlocking portion 79 projecting up on the rear side of each of the side pieces 72. A base 80 is provided between the two interlocking portions 78, 79 and deformation spaces for the interlocking portions 78, 79 are formed between the interlocking portions 78, 79 and the base 80. A first locking claw 81 projects forward from the upper projecting end of each first interlocking portion 78 and is resiliently engageable with the first lock 29. Upper and lower second locking claws 82, 83 project back from the projecting end of the second interlocking portion 79 and are resiliently engageable with the second lock 30.

The retainer 70A is movable vertically along the inserting direction ID between a partial locking position 1P and a full locking position 2P. The second locks 30 can be held tightly between the upper and lower locking claws 82 and 83 and the lower surfaces of the first locks 29 can contact the upper surfaces of the first locking claws 81 to hold the retainer 70A the partial locking position 1P, as shown in FIG. 15. In this state, the exposure portion 75 is below the lower surface of the housing main body 11 and the retaining portions 74 are retracted from the corresponding cavities 19 to permit insertion and withdrawal of the female terminal fittings 110 into and from the cavities 19. On the other hand, the lower surfaces of the first locking claws 81 can engage the upper surfaces of the first locks 29 and the lower surfaces of the lower locking claws 83 can engage the upper surfaces of the second locks 30 to hold the retainer 70A at the full locking position 2P, as shown in FIG. 16. In this state, the exposure portion 75 is retracted inside the housing main body 11 and the retaining portions 74 are in the corresponding cavities 19 to engage the rear jaws 115 of the female terminal fittings 110 that have been inserted properly into the cavities 19 to retain the female terminal fittings 110. Inner surfaces between the upper and lower locking claws 82 and 83 are shaped to conform to the outer shape of the second lock 30. Further, the lower surface of the exposure portion 75 functions as an operable surface to be pushed upon moving the retainer 70A from the partial locking position 1P to the full locking position 2P.

Figure 20:
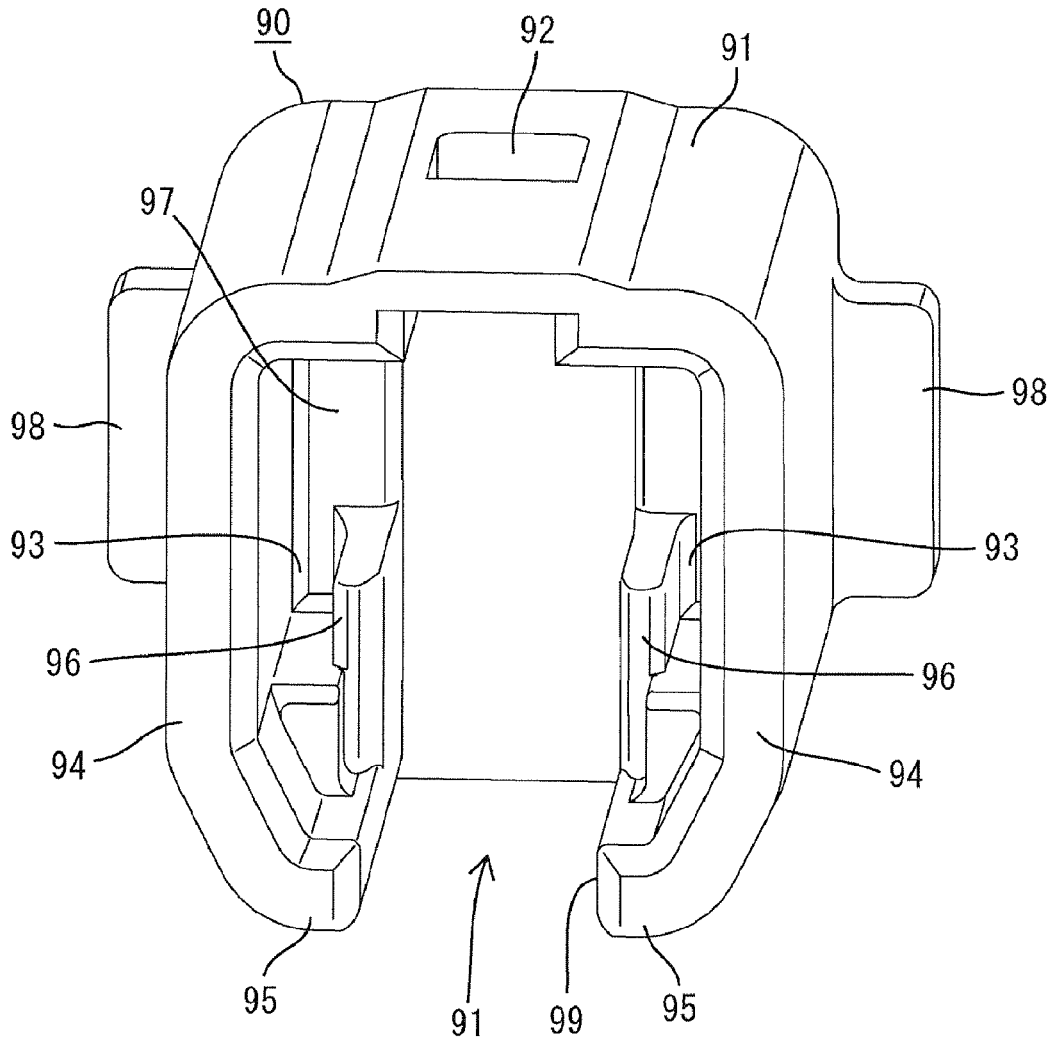
FIG. 20 is a perspective view of the holder.

The holder 90 is made e.g. of synthetic resin and, as shown in FIG. 20, is a substantially rectangular tube with open front and lower sides. The holder 90 includes a mount space 91 for receiving the projecting plate portion 32 of the female housing 10 from the front. A substantially rectangular holder interlocking portion 92 penetrates a widthwise central part of an upper wall 91 of the holder 90 immediately behind a slant for guiding the holder lock 38 and is engageable with the holder lock 38.

The holder 90 is formed with left and right second-plate accommodating recesses 93 capable of receiving the second plates 34 of the projecting plate portion 32. Each second-plate accommodating recess 93 is defined by a substantially vertical side wall 94, a substantially horizontal bottom wall 95 continuous with the bottom end of the side wall 94 and an inner wall 96 continuous with the inner end of the bottom wall 95 and substantially parallel to the side wall 94. A distance between the side wall 94 and the inner wall 96 is equal to or slightly larger than the thickness of the second plate 34. The holder 90 also includes left and right rear walls 97 integrally joined with the rear ends of the side walls 94, the bottom walls 95 and the inner walls 96 to substantially close the rear surfaces.

The holder 90 also is formed with the wire draw-out opening 99 for permitting the wires W to be drawn out to the outside. The wire draw-out opening 99 extends down substantially orthogonal to forward and backward directions FBD. Specifically, the wire draw-out opening 99 is arranged over substantially the entire length of the holder 90 between the inner edges of the left and right bottom walls 95 substantially facing in parallel with each other. The wire draw-out opening 99 and the housing-side wire draw-out opening 37 are arranged substantially side by side while partly overlapping in forward and backward directions FBD when the projecting plate portion 32 is mounted properly in the holder 90. Further, ears 98 are provided on central parts of both side walls 94 in the height direction.

The second plates 34 of the projecting plate portion 32 slidably move back and are positioned in the corresponding second-plate accommodating recesses 93 in the process of inserting the projecting plate portion 32 into the mount space 91 of the holder 90. The holder lock 38 and the holder interlocking portion 92 resiliently engage when the projecting plate portion 32 is inserted to a proper depth into the mount space 91 of the holder 90 to keep the projecting plate portion 32 positioned. As a result the female housing 10 is held and positioned in the holder 90. The inner walls 96 function as inclination preventing portions for preventing the second plates 34 from being inclined inwardly toward the wires W.

Figure 19:
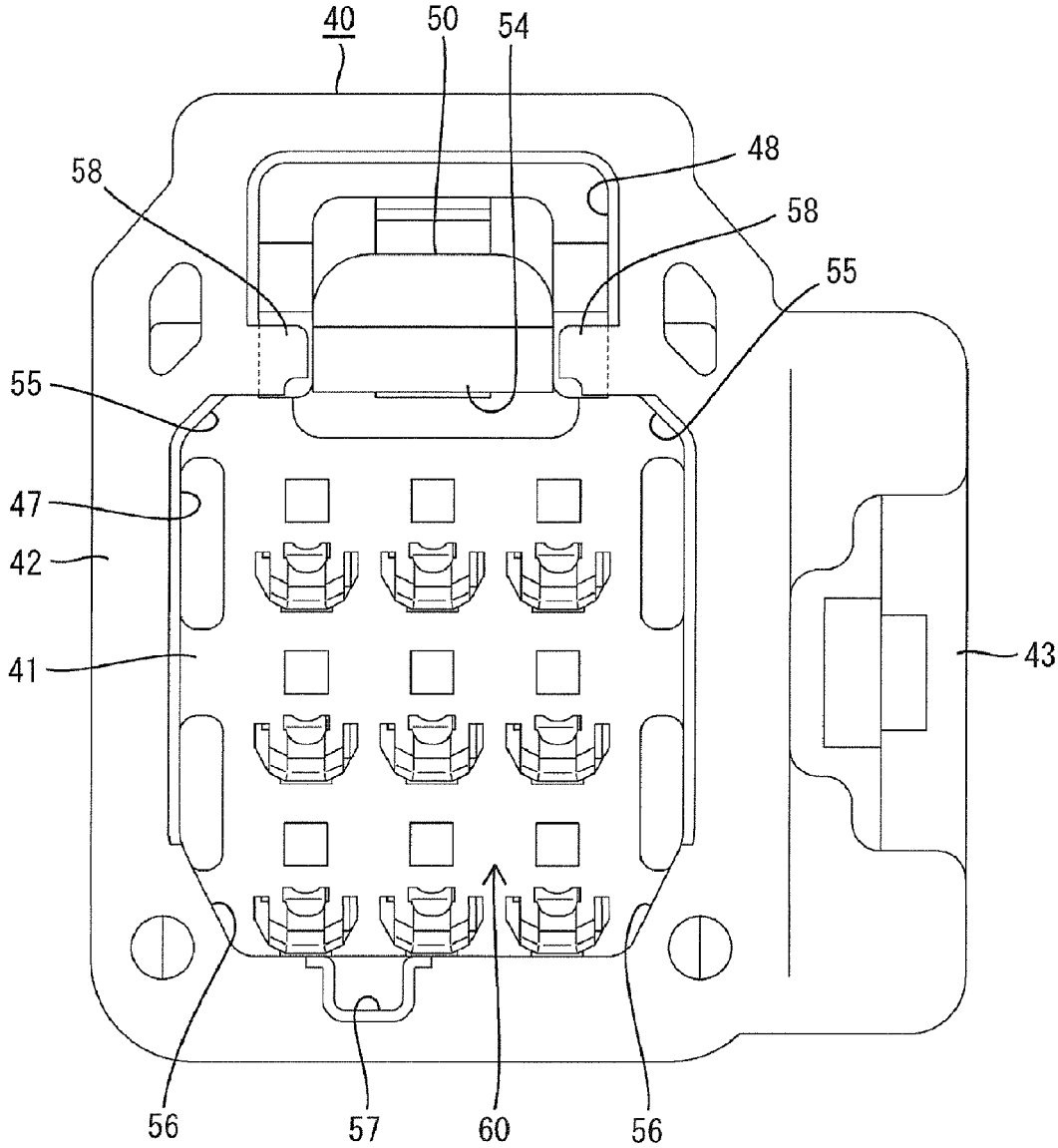
FIG. 19 is a front view of a male housing.

The male housing 40 is made e.g. of synthetic resin and has a substantially block-shaped terminal accommodating portion 41 and a rectangular tubular receptacle 42 that projects forward from the front end of the terminal accommodating portion 41, as shown in FIGS. 1 and 19. A mounting portion 43 is provided on one side surface of the male housing 40.

Cavities 44 are formed in forward and backward directions FBD in the terminal accommodating portion 41 for accommodating the male terminal fittings 140. A resiliently deformable locking lance 45 is formed at the inner lower surface of each cavity 44 for retaining the male terminal fitting 140. A retainer mount hole 46 is formed in the lower surface of the terminal accommodating portion 41 and can receive the retainer 70B from below and along an insertion direction ID'. The shapes of the locking lances 45 and the retainer 70B are basically the same as those of the above-described locking lances 24 and the retainer 70A and no repeated description is made.

Each male terminal fitting 140 is formed by bending, folding and/or embossing a unitary electrically conductive metal plate. The male terminal fitting 140 has a tubular terminal main body 141 and a thin tab 142 projects forward from the front end of the terminal main body 141. A wire barrel 143 is located behind the terminal main body 141 for connection with a core at an end of a wire W and an insulation barrel 144 is located behind the wire barrel 143 for connection with an insulation coating at the end of the wire W. A lance hole 145 is formed in the terminal main body 141 for receiving a locking projection 46 of the locking lance 45, and a rear jaw 146 of the terminal main body 141 is to be locked by the retainer 70B.

The receptacle 42 is located before the terminal accommodating portion 41 and has an inner surface shape substantially conforming to the outer surface shape of the housing main body 11. The receptacle 42 includes a fitting recess 47 capable of accommodating and positioning the female housing 10. A substantially U-shaped lock forming recess 48 bulges out from the upper surface of the terminal accommodating portion 41, and includes an inner space where the both recesses 47, 48 communicate in the height direction. A lock 50 is arranged between the lock forming recess 48 and the terminal accommodating portion 41 for resiliently engaging the interlocking portion 17 for holding the two housings 10, 40 together. The lock 50 has a leg 51 that stands up from the front end of the upper surface of the terminal accommodating portion 41 and an arm 52 that extends in forward and backward directions FBD from the upper end of the leg 51. The arm 52 can be displaced resiliently like a seesaw in the height direction with the leg 51 as a support. The rear end of the arm 52 is located above the upper surface of the terminal accommodating portion 41, and an unlocking portion 53 near the rear end of the arm 52 can be pressed to cancel the connected state of the two housings 10, 40. The front end of the arm 52 is located in the lock forming recess 48, and the lock claw 54 projects down from the front end of the arm 52 for engaging the interlocking portion 17.

Four corners of the inner surfaces of the fitting recess 47 are thickened toward the fitting space 60 to form receiving surfaces 55, 56 corresponding to the bevels 14, 15. The receiving surfaces 55, 56 are formed over substantially the entire length of the receptacle 42 in forward and backward directions FBD and include a two moderately inclined receiving surfaces 55 at opposite sides of the upper surface and conforming to the moderately inclined bevels 14 and two steeply inclined receiving surfaces 56 at the opposite sides of the lower surface and conforming to the steeply inclined bevels 56. No thickened parts conforming to the recesses 16 are formed at the inner surfaces of the fitting recess 47. Thus, clearances are formed between the inner surfaces of the fitting recess 47 and the inner surfaces of the recesses 16 when connecting the two housings 10, 40.

An erroneous connection preventing recess 57 is formed on the inner lower surface of the fitting recess 47 at a position facing the lock forming recess 48 and displaced toward one lateral side of the widthwise center. The erroneous connection preventing recess 57 has a substantially rectangular inner surface conforming to the outer shape of the erroneous connection preventing portion 27 and hence can receive the erroneous connection preventing portion 27 when connecting the two housings 10, 40. The erroneous connection preventing recess 57 extends from the front end of the receptacle 42 to a position near the back end to be longer than the erroneous connection preventing portion 27. Another male housing (not shown) includes an erroneous connection preventing recess 57 at a different position.

Restrictions 58 are formed on the inner surfaces of the lock forming recess 48 and interfere with the front end of the female housing 10 if the female housing 10 is inverted or inclined to project into the lock forming recess 48. Specifically, two restrictions 58 are arranged at positions on the opposite inner side surfaces of the lock forming recess 48 facing the fitting space 60 of the fitting recess 47 and project horizontally in while being connected with the upper ends of the moderately inclined receiving portions 55. The restrictions 58 and the lock claw 54 overlap each other in the height direction.

Figure 18:
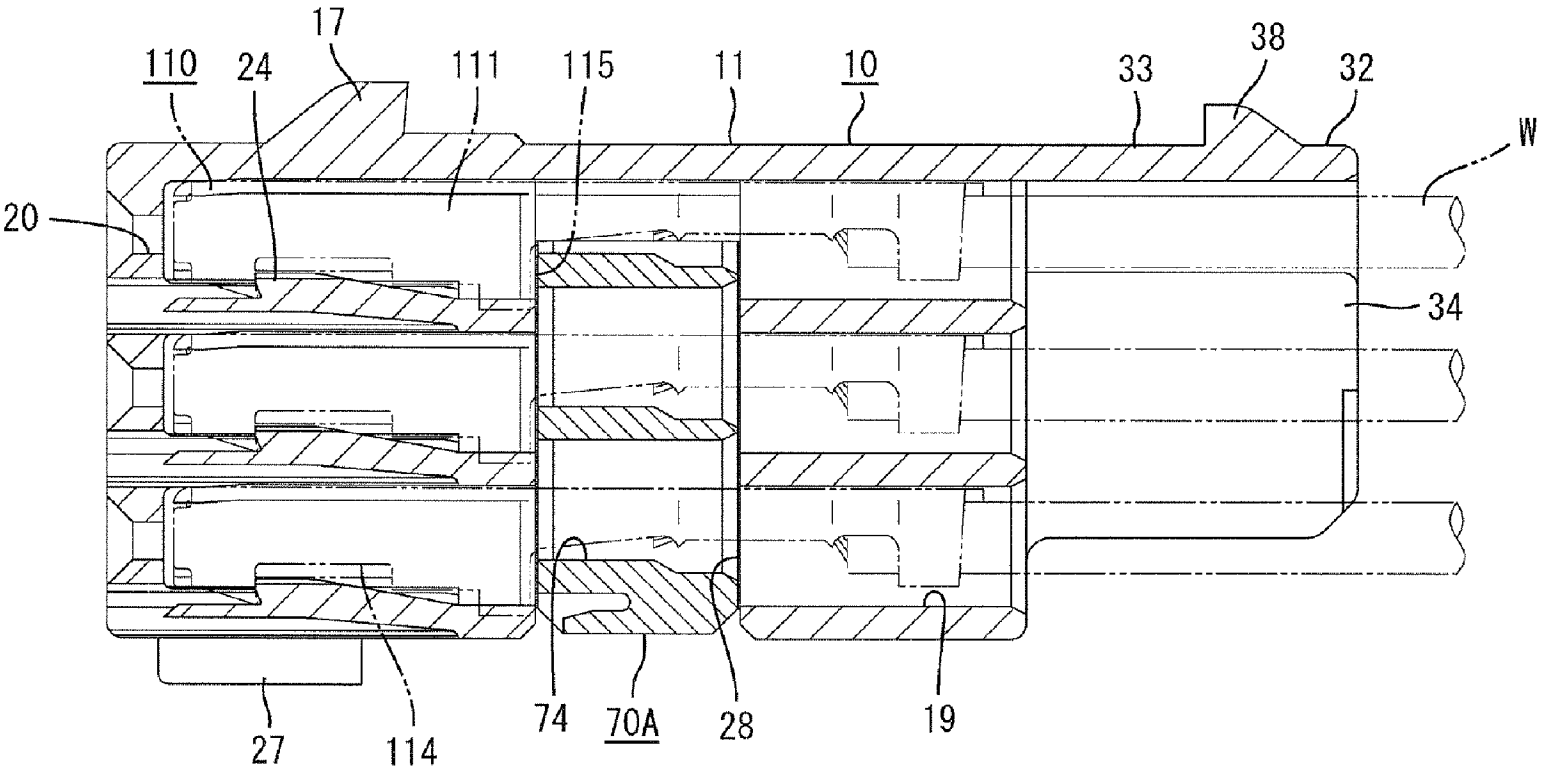
FIG. 18 is a section of the cavity part of the female housing showing the state where the female housing is held at the full locking position.

The retainer 70A is held at the partial locking position 1P in the female housing 10 and, in this state, the female terminal fittings 110 are inserted into the cavities 19 of the female housing 10. The properly inserted female terminal fittings 110 are retained primarily by the locking lances 24. The retainer 70A is pushed to the full locking position 2P after all of the female terminal fittings 110 are inserted so that the retaining portions 74 face the rear jaws 115 of the female terminal fittings 110 for secondarily retaining the female terminal fittings 110, as shown in FIG. 18. The respective facing edges of the exposure portion 75 of the retainer 70A and the opening of the retainer mount hole 28 are beveled to form the slants 39, 76 that prevent external matter, such as the wires W, from getting caught by these edges. The male terminal fittings 140 similarly are accommodated and retained in the cavities 44 of the male housing 40.

Figure 2:
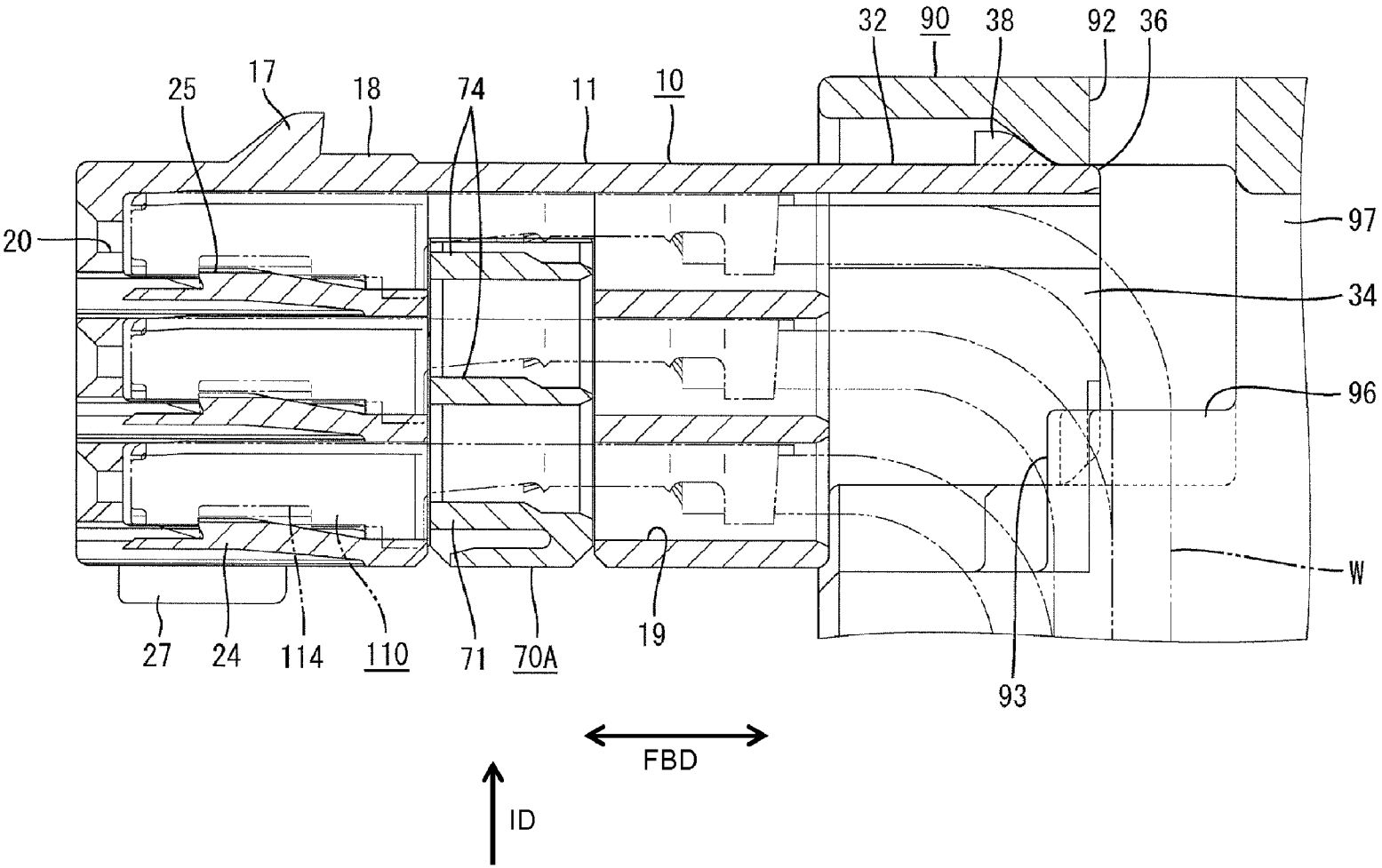
FIG. 2 is a section showing a state in the process of mounting the female housing into the holder.
Figure 3:
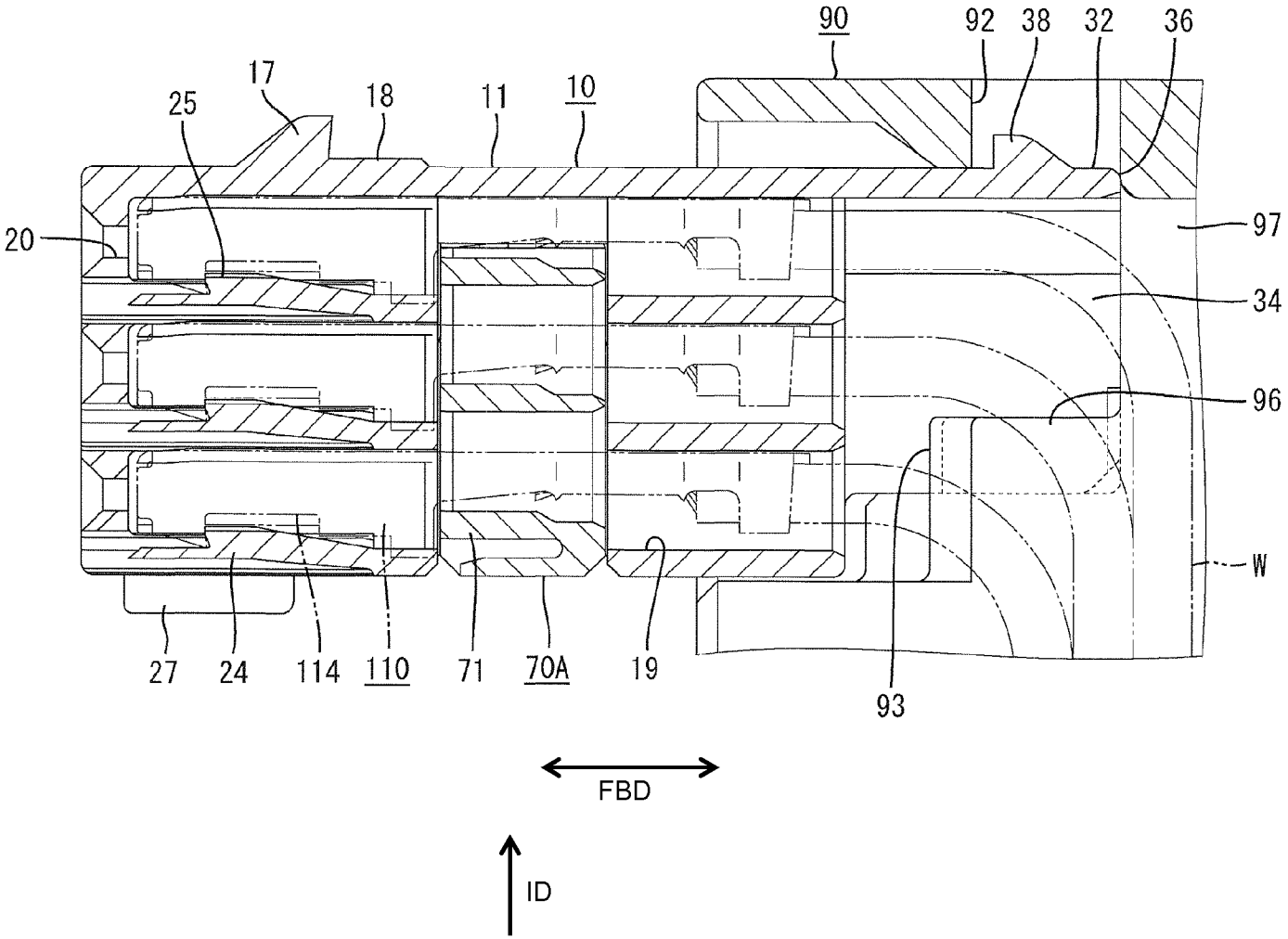
FIG. 3 is a section showing a state where the female housing is mounted in the holder.
Figure 4:
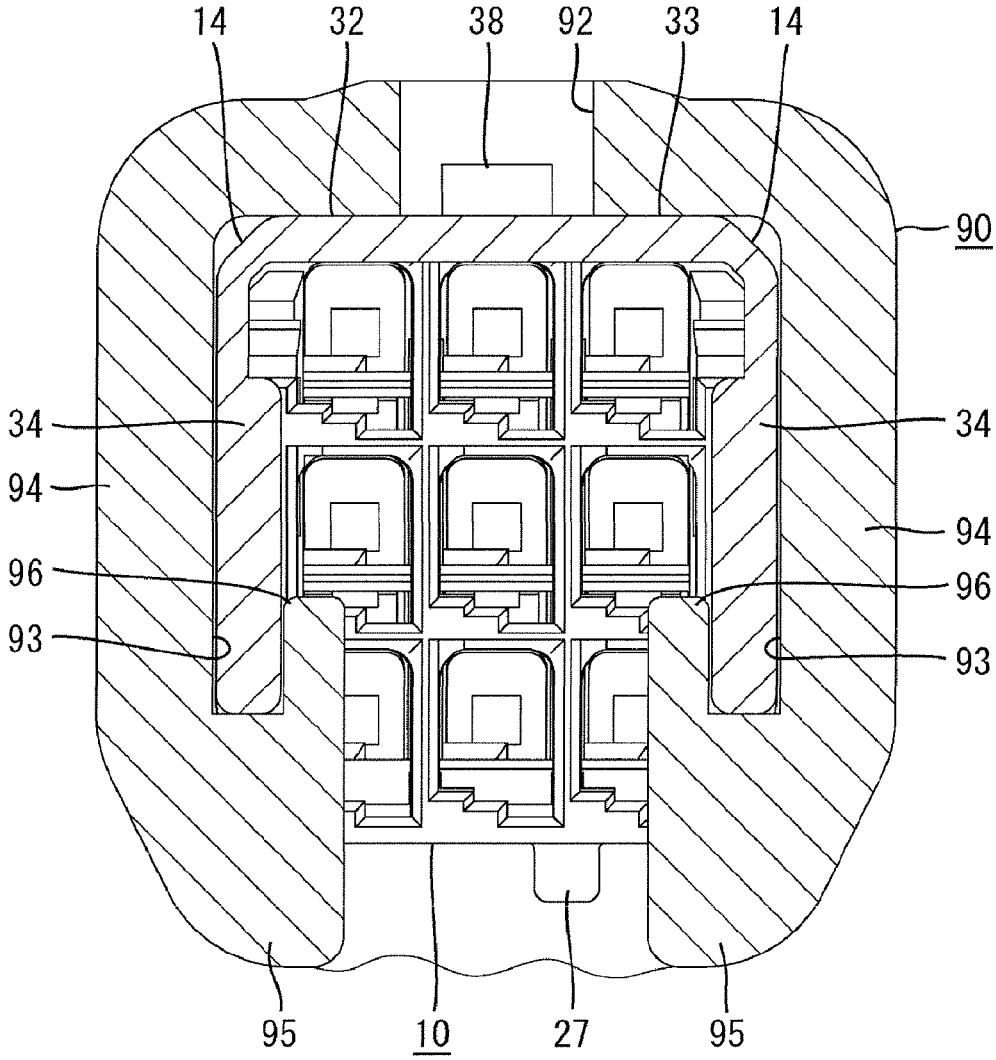
FIG. 4 is a section showing a state where second plates are accommodated in second-plate accommodating recesses in a connected state when viewed from behind.

The female housing 10 is inserted into a through hole 101 in a panel 100 from the front toward the rear, and the female housing 10 is inserted to the mount space 91 of the holder 90 at the rear side of the panel 100 with the rear end thereof in the lead. The second plates 34 are inserted into the second-plate accommodating recesses 93 while being positioned as shown in FIG. 2 in the process of inserting the female housing 10. As a result, the female housing 10 is prevented from being displaced in the height and width directions and the holder lock 38 is guided to a position facing the holder interlocking portion 92. The holder lock 38 resiliently engages the holder interlocking portion 92 when the female housing 10 is mounted properly into the holder 90 to prevent separation of the female housing 10 from the holder 90, as shown in FIG. 3. At this time, as shown in FIG. 5, the contact end surfaces 36 of the projecting plate 32 rest in contact with the front surfaces of the rear walls 97 of the holder 90 and the wires W contact the mounting object and the rear walls 97 to be bent forcibly down. The bent wires W are drawn out to the outside through the housing-side wire draw-out opening 37 and the wire draw-out opening 99. The side walls 94 prevent outward deformations of the second plates 34 and the inner walls 96 prevent inward deformations of the second plates 34 so that the second plates 34 are accommodated closely in the second-plate accommodating recesses 93 when the female housing 10 is mounted properly in the holder 90, as shown in FIG. 4.

Figure 8:
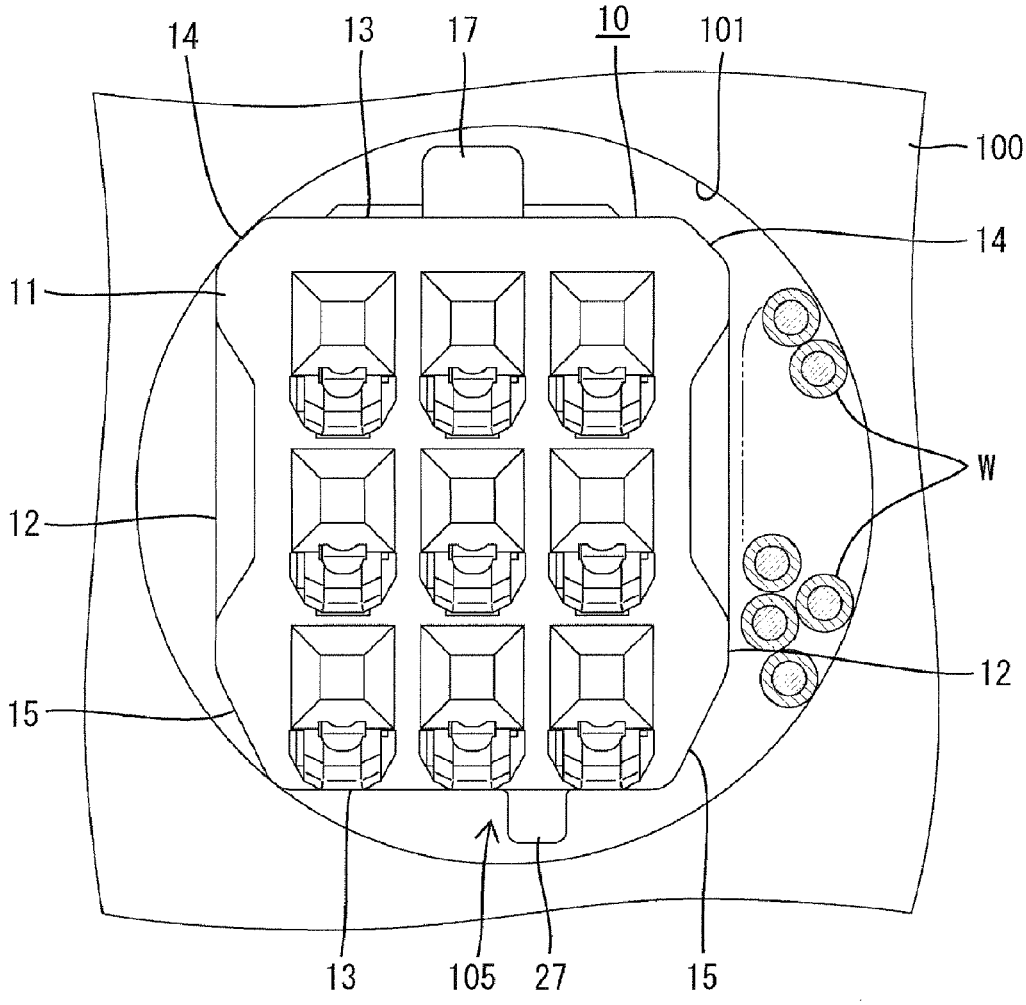
FIG. 8 is a front view showing a state where the female housing is inserted into a though hole of a panel.

In the above case, if another housing (not shown) already is arranged at the rear side of the through hole 101 and a bundle of wires W drawn out from this housing are inserted into the through hole 101, a housing insertion area in the through hole 101 is taken up and the above operation of inserting the female housing 10 may be hindered. However, the bevels 14, 15 are formed at the corners of the female housing 10 and the erroneous connection preventing portion 27 is provided on the lower surface as the shorter side, 13 as shown in FIG. 8. Thus, the female housing 10 is permitted to be inserted into the through hole 101 so that the longer side 12 and the wires W substantially face each other while the wires W are avoided. More particularly, the erroneous connection preventing portion 27 is provided on the surface of the housing main body 11 where the interlocking portion 17 projects. Thus, the erroneous connection preventing portion 27 is at a position where interference with the edge of the through hole 101 can be avoided, unlike the case where the erroneous connection preventing portion 27 is at each of the opposite sides of the interlocking portion 17.

The male housing 40 then is positioned to face the female housing 10 and, in this state, the housing main body 11 is fit into the receptacle 42. At this time, if the female housing 10 is in a proper connecting posture, the moderately inclined bevels 14 and the steeply inclined bevels 15 conform to the corresponding moderately and steeply inclined receiving surfaces 55 and 56 and are slidable thereon to guide the female housing 10 smoothly to the back side of the receptacle 42. The lock 50 engages interlocking portion 17 when the female housing 10 reaches a properly connected state to hold the two housings 10, 40 together, as shown in FIG. 1. At this time, the housing main body 11 is fit mostly in the receptacle 42 and the projecting plate portion 32 is fit entirely in the holder 90.

An attempt could be made to connect the female housing 10 in a vertically inverted posture. Thus, the steeply inclined bevels 15 face the moderately inclined receiving surfaces 55 and the moderately inclined bevels 14 face the steeply inclined receiving surfaces 56, as shown by chain double-dashed line in FIG. 6 and the front end of the housing main body 11 contacts the front end of the receptacle 42. As a result, the connecting operation of the two housings 10, 40 is hindered so that the female housing 10 cannot be connected with the male housing 40 in the vertically inverted posture.

An attempt could be made to insert the female housing 10 forcibly in the vertically inverted posture. Thus, there is a likelihood that the female housing 10 will enter the fitting recess 47 and the lock forming recess 48 while being rotated about an axis extending in forward and backward directions FBD to take an oblique posture. However, the female housing 10 held in the vertically inverted and oblique posture interferes with the restrictions 58 to hinder any further inserting operation. Therefore, the female housing 10 cannot be connected with the male housing 40 while being held in the vertically inverted posture.

The erroneous connection preventing portion 27 slidably (at least partly) enters the erroneous connection preventing recess 57 in the process of connecting the two housings 10, 40 and is at least partly fitted and/or at least partly accommodated in the erroneous connection preventing recess 57 after the two housings 10, 40 are connected. At this time, if an attempt is made to connect another female housing 10A, the erroneous connection preventing portion 27 thereof does not correspond to the erroneous connection preventing recess 57 and comes into contact with the front end of the receptacle 42, thereby hindering any further connecting operation. Therefore, there is no likelihood of erroneously connecting the two housings 10, 40.

If the female housing 10 is in the substantially proper connecting posture, the beveled portions 14, 15 conform to the corresponding parts of the receptacle 42 and the connecting operation of the two housings 10, 40 proceeds without any difficulty. On the other hand, if the female housing 10 is wrongly oriented (e.g. vertically inverted), the beveled portions 14, 15 do not conform to the corresponding parts of the receptacle 42 and the connecting operation of the two housings 10, 40 is hindered. Accordingly, an erroneous connection of the two housings 10, 40 can be prevented by confirming such states. In this case, since the means for preventing the erroneous connection is formed by the beveled portions 14, 15, the female housing 10 does not increase in volume and, consequently, the entire connector including the male housing 40 can be compact unlike in the case of using such a means in the form of a projection.

Since the beveled portions 14, 15 preferably include the steeply inclined portions 15 and the moderately inclined portions 14 and/or the first locking portions 29 preferably are provided at the inner sides of and proximate to the moderately inclined portions 14, the regions P thicker than the steeply inclined portions 15 at the inner sides of the moderately inclined portions 14 are effectively utilized, thereby improving space efficiency.

Further, since the facing edges of the exposure portion 75 of the retainer 70A and the retainer mount hole 28 are beveled to form the slanted portions 39, 76, it can be prevented that the insulation coatings of the wires W are cut or the retainer 70A is inadvertently separated from the female housing 10 due to the wires W getting caught by the facing edge of the exposure portion 75.

If the female housing 10 is in such a vertically inverted and oblique posture as to project into the lock-portion forming recess 48, the housing main body 11 interferes or may interfere with the restricting portions 58 to hinder any further connecting operation, wherefore it can be avoided that the female housing 10 is inserted into the receptacle 42 while being held vertically inverted.

Since the erroneous connection preventing portion 27 preferably is provided at the position of the lower surface of the housing main body 11 corresponding to the partition wall 22 partitioning the adjacent ones of the cavities 19, the arrangement position of the erroneous connection preventing portion 27 does not change even if the locking lance 24 connected with the lower surface of the inner wall of the cavity 19 is resiliently deformed. Therefore, the reliability of an erroneous connection preventing function is improved.

Further, since the erroneous connection preventing portion 27 preferably projects from the lower surface of the housing main body 11 which is the shorter side portion 13 opposite to the one 13 where the interlocking portion 17 is provided, a clearance formed between the outer surface of the housing main body 11 and the inner surface of the through hole 101 can serve as an insertion space 105 (see FIG. 8) for the erroneous connection preventing portion 27 when the female housing 10 is inserted into the through hole 101. Therefore, the female housing 10 can be smoothly inserted into the through hole 101.

Since the cutouts 26, which the leading ends of the resiliently deformed locking lances 24 can enter, preferably are formed in the outer surface of the housing main body 11, it is not necessary to provide a wall for forming deformation spaces for the locking lances 24 and a reduction in the height of the female housing 10 is realized by that much. In this case, since the leading ends of the locking lances 24 preferably are exposed through the cutouts 26, they may be possibly broken or fractured by coming into interference with an external matter. However, according to this embodiment, the erroneous connection preventing portion 27 preferably is arranged between the adjacent cutouts 26, wherefore the external matter comes into contact with the erroneous connection preventing portion 27 to avoid interference with the locking lances 24.

Further, since the projecting plate portion 32 preferably projects substantially backward from the rear surface of the female housing 10 and/or preferably is at least partly inserted into the holder 90 with the rear end thereof in the lead to be held in the holder 90, the female housing 10 can be mounted into the holder 90 with the rear surface thereof in the lead. Furthermore, since the projecting plate portion 32 preferably is provided between the rear surface of the female housing 10 and the holder 90 and the wire draw-out opening 99 is formed in the holder 90, a sufficient space used to arrange the wires W can be ensured in the projecting plate portion 32 and the holder 90.

Since the wires W can be drawn out from both the wire draw-out opening 99 and the housing-side wire draw-out opening 37, forcible bending of the wires W is prevented and a degree of freedom in arranging the wires W is improved in the projecting plate portion 32 and the holder 90. Further, since the projecting plate portion 32 preferably is comprised of the first plate 33 and the second plates 34 connected with the first plate 33 in the intersecting direction with the first plate 33 and having free ends, a simplified structure is realized.

Further, since the holder 90 preferably includes the inner walls 96 for preventing the second plates 34 from being inclined toward the wires W, deformations of the second plate 34 upon mounting the projecting plate portion 32 into the holder 90 are avoided to improve reliability in mounting the female housing 10 into the holder 90.

Since the projecting plate portion 32 has a small thickness to meet a demand for miniaturization, there is a possibility that the projecting plate portion 32 is deformed and the holder interlocking portion 92 and the holder locking portion 38 are displaced from proper locking positions to reduce locking reliability in the process of the mounting the projecting plate portion 32 into the holder 90. However, according to this embodiment, the projecting plate portion 32 preferably is positioned by inserting the second plates 34 into the second-plate accommodating recesses 93 and, in this state, the holder interlocking portion 92 and the holder locking portion 38 are engaged. Therefore, the holder interlocking portion 92 and the holder locking portion 38 are or can be reliably brought to the proper locking positions to improve the locking reliability.

The present invention is not limited to the above described and illustrated embodiment. For example, the following embodiments are also included in the technical scope of the present invention.

It is sufficient for the diagonal corner portions on the outer surfaces of the housing main body to be beveled to have different shapes. For example, the respective corner portions may all have different shapes.

The beveled portions are not limited to straight slanted surfaces and may be curved round or rounded surfaces.

The slanted portions are not limited to straight slanted surfaces and may be curved round or rounded surfaces.

The slanted portions may not be formed at the opening edges of the retainer mount hole.

Only one restricting portion may be provided.

Parts of the lower surface of the housing main body facing the leading ends of the locking lances may be closed without being formed into the cutouts The projecting plate may be formed to be L-shaped in a rear view by connecting the first plate and the second plate at right angles or may be comprised of either one of the first and second plates. Further, the projecting plate portion may be formed to have a substantially semi-circular cross section which is open toward the housing-side wire draw-out opening.

Contrary to the above embodiment, the holder locking portion may be a recess and the holder interlocking portion may be a projection.

Contrary to the above embodiment, the lock portion may be in the form of a table-shaped projection and the interlocking portion may be in the form of an arm portion extending in forward and backward directions.

The holder locking portion may be provided on the second plate.

The holder and the mounting object may be separate bodies.

The wire draw-out opening may be an opening extending in an oblique direction intersecting with forward and backward directions in the holder.

The wire draw-out opening and the housing-side wire draw-out opening may be separated from each other in forward and backward directions.

The wire draw-out opening and the housing-side wire draw-out opening may entirely overlap in forward and backward directions.

What is claimed is:

1. A connector, comprising a pair of first and second housings connectable with each other, the first housing including a housing main body and the second housing including a receptacle having an inner surface shape substantially conforming to outer surfaces of the housing main body, and a lock-portion forming recess and a lock portion are formed in the first housing to engage with a lock arm of the second housing for holding a connected state with the first housing, the lock-portion forming recess including at least one restricting portion partly projecting into the inside of the lock-portion forming recess and toward the lock arm which interferes with the first housing when the first housing is in such an improper orientation, wherein corner portions of the outer surfaces of the housing main body diagonal to each other are formed into beveled portions with different shapes.

2. The connector of claim 1, wherein:

the housing main body is formed with a retainer mount hole, into which a retainer for retaining one or more terminal fittings at least partly accommodated in the housing main body is to be mounted, at least one retainer locking portion for holding the retainer in the housing main body is provided on an inner surface of the retainer mount hole, the beveled portions preferably include at least one moderately inclined portion inclinedat a relatively large angle with respect to an inserting direction of the retainer into the retainer mount hole and at least one steeply inclined portion inclined at a relative small angle with respect to the inserting direction, and the retainer locking portion preferably is provided at an inner side of and proximate to the moderately inclined portion.

3. The connector of claim 2, wherein:

the retainer includes an exposure portion exposed to the outside through an opening of the retainer mount hole, and out of facing edges of the exposure portion and the opening, at least the facing edge of the exposure portion is beveled.

4. A connector, comprising:

a first housing including a plurality of cavities, into which terminal fittings are at least partly insertable, each of the cavities being adjacent to at least one other of the cavities, partition walls being formed between the cavities that are adjacent to one another, at least one resiliently deformable locking lance for retaining the terminal fitting being formed at an inner surface of each cavity, the first housing further being formed with cutouts at positions corresponding to leading ends of the locking lances, wherein:

an erroneous connection preventing portion for preventing an erroneous connection with a mating second housing projects from an outer surface of the first housing, and the erroneous connection preventing portion is arranged at a position located on a surface at the same side as the inner surfaces of the cavities connected with the base ends of the locking lances and substantially aligned with one of the partition walls partitioning adjacent ones of the cavities and between adjacent ones of the cutouts so that a position of the erroneous connection preventing portion remains constant when the locking lances are deformed resiliently.

5. The connector of claim 4, wherein:

outer surfaces of the first housing include two shorter sides and two longer sides, and an interlocking portion for holding the second housing in a connected state projects from one of the two shorter sides, whereas the erroneous connection preventing portion preferably projects from the other shorter side.

6. A connector, comprising:

a first housing which can at least partly accommodate one or more terminal fittings connected with respective ends of one or more wires and from a surface of which the wires are to be drawn out, and a holder, into which the first housing is to be at least partly mounted, wherein:

a projecting plate portion arranged to at least partly surround the wires projects backward from the surface of the first housing, the projecting plate portion having a first plate and a second plate connected with the first plate in an intersecting direction with the first plate and having a free end the projecting plate portion being formed with a housing-side wire draw-out opening extending in a direction intersecting with forward and backward directions and adapted to permit the wires to be drawn out to the outside, the projecting plate portion is to be inserted and held into the holder provided on a mounting object with the rear end thereof in the lead, and the holder is formed with a wire draw-out opening extending in a direction intersecting with forward and backward directions and adapted to permit the wires to be drawn out to the outside, the holder including an inclination portion and substantially parallel with the first and second plates for preventing an inward inclination of the second plate toward the wires by being arranged in contact with the inner surface of the second plate.

7. The connector according of claim 6, wherein:

the holder includes a holder interlocking portion, the projecting plate portion includes a holder locking portion, the holder interlocking portion and the holder locking portion are engaged with each other to prevent the holder and the first housing from being separated from each other, the holder preferably is formed with a second-plate accommodating recess, into which the second plate is at least partly insertable, by walls including the inclination preventing portion, and the projecting plate portion is positioned by inserting the second plate into the second-plate accommodating recess and, in this state, the holder interlocking portion and the holder locking portion are engaged.

* * * * *